US006443214B1

(12) United States Patent
Matsuo et al.

(10) Patent No.: US 6,443,214 B1
(45) Date of Patent: Sep. 3, 2002

(54) METHOD FOR HEAT TREATING MOLD CAST PRODUCT

(75) Inventors: Nobuki Matsuo; Toshiaki Ohnuma; Tomotaka Takahashi, all of Sayama; Noriyuki Yamada, Wako, all of (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/456,832

(22) Filed: Dec. 7, 1999

(51) Int. Cl.[7] ..... B22D 27/04; C21D 9/30
(52) U.S. Cl. ..... 164/126; 164/125; 148/904
(58) Field of Search ..... 164/126, 125, 164/352, 458, 76.1; 148/904

(56) References Cited

U.S. PATENT DOCUMENTS 3,905,415 A * 9/1975 Lefebvre ..... 164/72
3,909,314 A * 9/1975 Armstrong et al. ..... 148/146
4,661,676 A * 4/1987 Morita et al. ..... 219/121 IM

FOREIGN PATENT DOCUMENTS

DE 19632195 2/1989
JP 2149640 6/1990
JP 56098416 8/1996

OTHER PUBLICATIONS

Search Report, Jun. 9, 2000.

* cited by examiner

*Primary Examiner*—M. Alexandra Elve
*Assistant Examiner*—Len Tran
(74) *Attorney, Agent, or Firm*—Merchant & Gould, P.C.

(57) ABSTRACT

A method for heat treating a mold cast product by releasing the product from a mold and hardening the product. Since the mold release is performed when a surface layer of the product held in contact with the mold has a hardening allowing temperature and after it becomes a shell-shaped solidified layer, the product immediately after release from the mold has a heat suitable for hardening. Using this heat, the product is thereafter hardened by means of a cooling agent. As a result, a heating process required for hardening can be omitted, thereby achieving energy conservation.

8 Claims, 23 Drawing Sheets

METHOD FOR HEAT TREATING MOLD CAST PRODUCT

BACKGROUND OF THE INVENTION

1. Field of the Invention

The present invention relates to an improved method for heat treating a mold cast product, particularly a camshaft.

2. Description of the Related Art

In conventional mold casting, a cast product is cooled deep inside while it is held in a mold, during which cooling process a constraining force of the mold is applied to the cast product, thereby causing cracks to arise in the cast product. A measure to prevent such cracking is proposed in, for example, Japanese Patent Kokoku (Post-Exam) Publication No. HEI-5-45347 disclosing a method for mold casting a workpiece comprising a camshaft. In the proposed casting method, after molten metal is poured into a mold, that part of the molten metal which is held in contact with the mold is rapidly cooled or quenched so that a shell-like solidified layer or skin is formed on the surface of the molten metal, whereafter the resulted cast workpiece is released from the mold. Since the workpiece is released from the mold with its inside kept in an unsolidified state, the workpiece is freed from its cracking. In addition, since the workpiece is released from the mold before its inside solidifies, the relevant production cycle time is shortened compared to that of the conventional mold casting, thereby increasing the productivity.

The proposed mold casting method is efficient and enables production of workpieces of excellent shape. However, the resulted cast products need to be subjected to additional heat treatment (hardening and tempering) so as to impart abrasion-resistive property and toughness thereto. This heat treatment includes three different heating processes, namely, a first heating for pre-casting melting, a second heating for hardening and a third heating for tempering, thereby requiring an increased amount of heat energy and increasing the number of production processes.

In the proposed casting method, the workpiece is hardened in its entirety. However, when the workpiece is a camshaft, a journal portion thereof should desirably be kept unhardened. Thus, in certain uses, the workpiece must have a hardened portion and a unhardened portion at the same time but this can hardly be achieved by the proposed casting method.

Consequently, there is a need to provide mold casting in which measures are taken to save energy and reduce the number of the required processes. In addition, there is a need to provide a technique which enables the coexistence of a hardened portion and a unhardened portion in a single workpiece.

It is already known to harden a camshaft by induction heating the camshaft to a hardening temperature and then soaking the heated camshaft into a cooling agent or emitting a jet of the cooling agent thereat. However, from the standpoint of energy conservation, it is more desirable to instantly forcedly cool such a product produced by the mold casting as proposed in Japanese Patent Publication No. 5-45347.

An elongate workpiece such as a camshaft is liable to be bent easily. Thus, one may propose rapidly cooling the workpiece while restraining the workpiece by means of an appropriate jig. However, since such an elongate workpiece shrinks substantially upon rapid cooling, the restraint by the jig may possibly interrupt the shrinkage, thereby causing cracks to arise in the workpiece.

Accordingly, there is a need for a technique which enables forced cooling of the workpiece and energy saving while preventing cracking of the workpiece.

In the mold casting of the above-described publication, the cast product is forcedly cooled in the mold. At this time, it is difficult to minutely control the cooling speed, because the mold has a large heat capacity.

Further, where the cast product is a camshaft, a cam portion of the camshaft needs to be hardened to increase the abrasion-resistivity thereof while a journal portion of the camshaft needs to be machined and thus should not be hardened. That is, a certain cast product needs to have a hardened portion and an unhardened portion at the same time. However, in the method of the above-described publication, although hardening of the entirety of the camshaft is possible, it is not possible to minutely control the cooling operation so that an unhardened portion can coexist with a hardened portion. Consequently, there is a need for a heat treatment method which enables the coexistence of a hardened potion and an unhardened portion in a single cast product.

To meet its use requirement, the camshaft produced by the method of Japanese Patent Laid-Open Publication No. HEI-5-45347 needs to have a hardened portion while a journal portion thereof should be kept unhardened, as described above. In providing such a product, it has been the conventional practice to mask the journal portion and then spray a cooling agent at the camshaft to thereby harden only the cam portion.

However, such a method in which the journal portion is covered with a masking of desired shape to prevent the journal portion from being sprayed with the cooling agent for hardening does not allow the required temperature control of the journal portion. Without such temperature control, there is a fear that rapid cooling or quenching of the adjoining cam portion will also quench the journal portion, thereby hardening the latter, This makes the relevant hardening operation more difficult to achieve and the range of control of the hardening operation narrower. Consequently, it is required to broaden the range of control of the hardening operation by controlling the cooling speed of a portion desired to be left unhardened.

SUMMARY OF THE INVENTION

According to a first aspect of the present invention, there is provided a heat treating method which comprises the steps of: pouring molten metal for iron-based parts into a mold to produce the cast product having a surface layer; releasing the cast product from the mold when the cast product surface layer held in contact with the mold is in a temperature range allowing hardening and became a shell-shaped solidified layer; and hardening the cast product released from the mold and having a hardening allowing temperature, by cooling the cast product with a cooling agent.

In this method, heat remaining in the product after release from the mold is used to harden the product, whereby heat for hardening becomes unnecessary. Consequently, it becomes unnecessary to establish a process for transporting the product to a hardening furnace, thus decreasing the number of required man hours.

Cooling of the mold cast product may be performed by spraying the cooling agent onto the product or soaking the product into the cooling agent.

Preferably, the cooling is performed by spraying the cooling agent locally onto part of the mold-released cast product where hardness is required. This makes it possible to provide a hardened part and an unhardened part in the product so that the hardened part has an abrasion-resistive property and increased toughness while the unhardened part has flexibility.

In a preferred form, the method further comprises the step of pre-cooling part of the mold-released cast product where hardness is not required. At this time, the hardening step may comprise spraying the cooling agent locally onto part of the mold-released cast product where hardness is required. This makes it possible to achieve the coexistence of a hardened portion and an unhardened portion in the product. In the pre-cooling step, the hardness required part of the mold cast product may be maintained at a temperature higher than an A1 transformation point while the hardness non-required part of the mold cast product may be cooled to a temperature lower than the A1 transformation point. By thus cooling the hardness non-required part to a temperature lower than the A1 transformation point, when the product is rehardened, the hardness required part will be hardened with the hardness non-required part remaining unhardened. It thus becomes possible to keep the hardness of the hardness non-required part to a minimum.

After the product releasing from the mold, the product may be restruck to correct a shape thereof and then subjected to forced rapid cooling done by spraying the cooling agent onto the cast product or by soaking the latter into the cooling agent while repeating alternate constraining and non-constraining of the product. Since the shape correction of the product is effected before hardening, a workpiece of excellent shape can be provided for hardening. Cracking of the resulting product can be avoided, because constraining in which the product is corrected in its deformation and bend while being held in a constrained state and non-constraining in which the product is left unconstrained to allow shrinkage are alternated during the hardening.

The alternate constraining and non-constraining of the cast product may be repeated until the temperature of the cast product reaches a martensitic transformation starting temperature (Ms point), whereafter the cast product may be held in a non-constrained state. The Ms point is approximately 180° C. Thermal deformation of the product below that temperature is subtle and hence the product does not need to be constrained any more. Below the Ms point, austenite transforms into martensite to thereby cause metallurgical expansion. Accordingly, it is desirable to disconstrain the product so as not to interrupt the transformational expansion.

It is preferable that the method also includes the step of interrupting the cooling when the temperature of the cast product surface layer drops to below a martensitic transformation starting temperature (Ms point) while the temperature of the inside of the product remains higher than the temperature of the product surface layer, so that self tempering of the product surface layer can be effected by an internal residual heat of the cast product. That is, low temperature tempering is effected by using the internal residual heat of the cooled product. As a result, it becomes possible to omit heating for tempering, thereby reducing the number of required man hours. Conventionally, heating has been required at three different occasions but only one time heating is required in the inventive method, thus contributing to energy conservation.

The self tempering may be effected by interrupting the cooling when the temperature of the product surface layer drops to below a martensitic transformation starting temperature (Ms point) and while the temperature of a cooling agent unsprayed part and the inside of a cooling agent sprayed part of the product remains higher than the temperature of the product surface layer, so that the hardened part can be self tempered by residual heat of the cooling agent unsprayed part and internal residual heat of the cooling agent sprayed part.

Desirably, the hardening step comprises spraying onto the cast product the cooling agent in the form of mist resulted from mixing water pressure with air pressure at a given ratio. By simply changing the water pressure to air pressure ratio, cooling rate can be altered, whereby minute cooling control is enabled.

The method may further comprise the step of masking a hardness non-required part of the mold-released cast product. In addition, the hardening step may comprise spraying the cooling agent onto a hardness required part of the product and causing a cooling rate to fall at least once during a drop in temperature of the target of cooling from an A1 transformation point to a martensitic transformation starting temperature (Ms point). By thus masking the part desired not to be hardened, a non-hardened part can be provided easily. Further, by decreasing the cooling rate during the cooling process, an unhardened part may be provided at the masked part. It is also desirable that the hardening comprises intermittently spraying the cooling agent onto the hardness required part and causing a cooling rate to fall at least once during a drop in temperature of the target of cooling from the A1 transformation point to the martensitic transformation starting temperature (Ms) by interrupting the cooling agent spraying.

According to a second aspect of the present invention, there is provided an apparatus for slowly cooling an iron-based part having a hardening allowing temperature, which comprises a plurality of cooling blocks held in contact with a part of the part desired to be slowly cooled. The cooling blocks each comprises: a cooling agent passage for allowing passage of a cooling agent; a recessed portion provided at an outlet of the cooling agent passage; and a porous material member received in the recessed portion so that the cooling agent can be moderately dispersed to thereby partially cool the iron-based part.

In the apparatus thus arranged, part desired to be slowly cooled by means of a cooling agent while controlling the cooling rate, and a part desired to be hardened is forcedly cooled separately. As a result, the resulting product has increased control precision in its entirety. Further, since the cooling agent is moderately dispersed by the porous material member, it becomes possible to cool part of the iron-based part at such a cooling rate that the cooled part does not become hardened.

Each of the cooling blocks may desirably be arranged to serve as a part of a restriking mechanism for correcting a shape of the iron-based part.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION OF THE PREFERRED EMBODIMENTS

In the embodiments discussed herein, a camshaft is taken up as an example of a mold cast product. However, the following description is merely exemplary in nature and is in no way intended to limit the invention or its application or uses.

Figure 1:
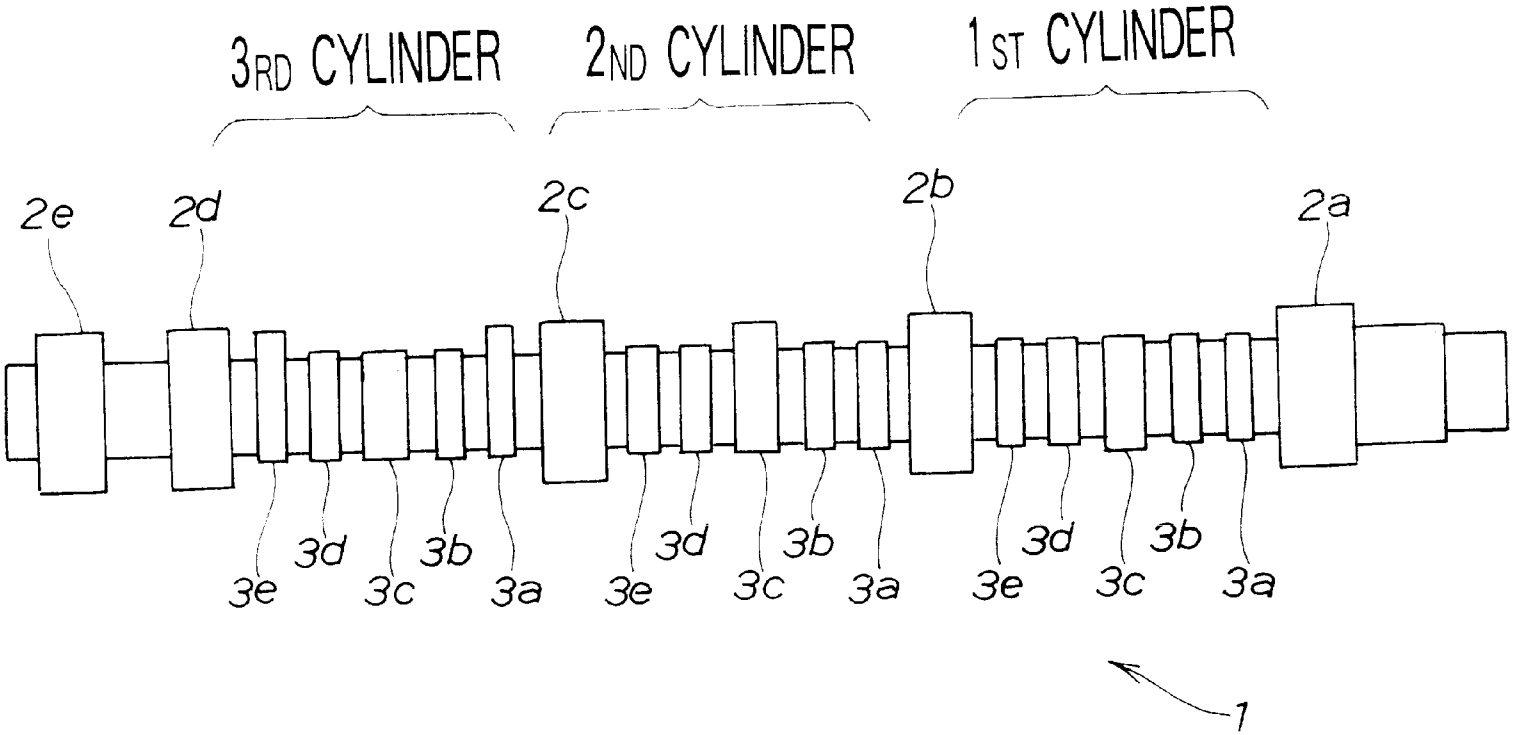
FIG. 1 is a general illustration of a product cast in accordance with the present invention.

Referring intially to FIG. 1, a camshaft 1 comprises a plurality of journal portions 2*a*–2*e* and five cam portions 3*a*–3*e* provided between adjacent two journal portions, namely, between jounal portions 2*a* and 2*b,* between 2*b* and 2*c,* and between 2*c* and 2*d.* The camshaft 1 is designed for three-cylinder application.

Components of the materials, spheroidal graphite cast iron, forming the cast product used in embodiments of the present invention and a comparative example, are shown in Table 1 below. The components of the comparative example have standard chemical compositions as indicated in the Manual of Metals (Japan Metal Society, 5th edition, page 596). In Table 1, Sn represents tin; Bi represents bismuth.

TABLE 1

| | C | Si | Mn | Cu | Mg | P | S | Mo | Sn | Bi | Fe |
|---|---|---|---|---|---|---|---|---|---|---|---|
| Embodiment | 3.2–4.0 | 3.0–4.5 | 0.5–0.9 | 0.6–0.9 | 0.010–0.030 | <0.06 | <0.02 | 0–0.4 | 0–0.04 | 0–0.004 | bal. |
| Comp. Ex. | 3.4–4.1 | 2.1–2.7 | 0.2–0.4 | — | >0.04 | <0.05 | <0.02 | — | — | — | bal. |

Spheroidal graphite cast iron is obtained by adding magnesium (Mg) to cast iron to thereby spheroidize graphite contained in the cast iron. In the embodiment, 0.01–0.03% of Mg is included.

The embodiment includes 1.5–2.0 times the silicon (Si) components of the embodiment. Increase in the amount of Si decreases the hardness of an unhardened portion so that the portion can be easily machined by a drill and a lathe.

Figure 2:
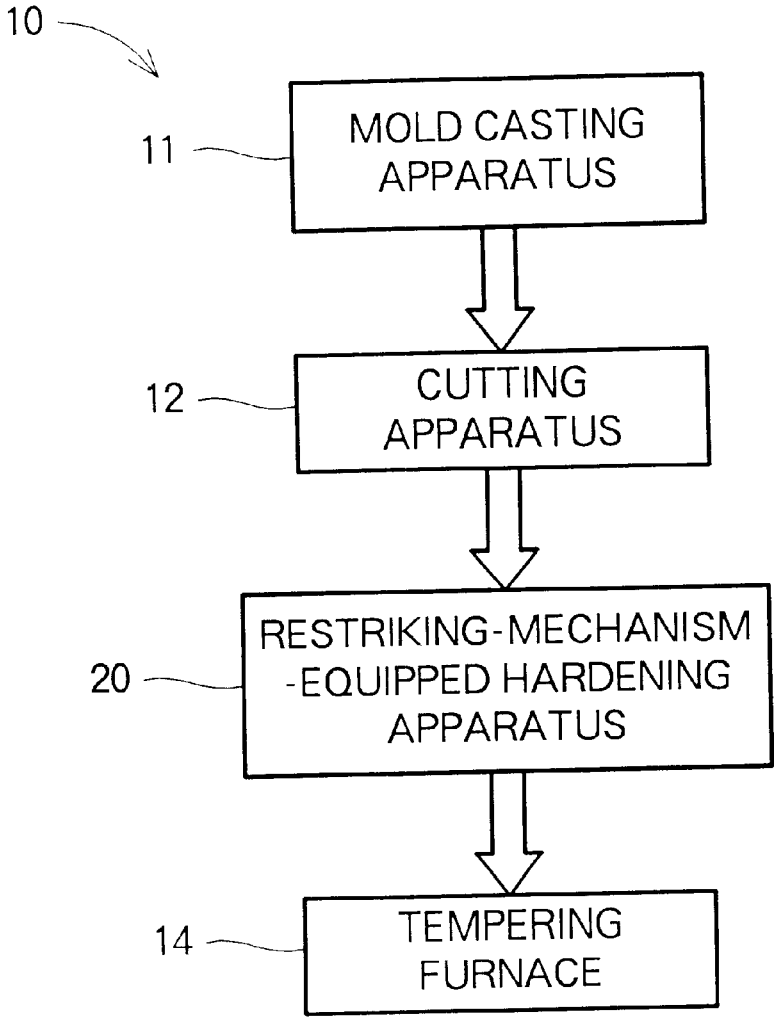
FIG. 2 illustrates the general arrangement of a heat treatment system according to the present invention.

Referring next to FIG. 2, a heat treatment system 10 comprises a mold casting apparatus 11, a cutting apparatus 12, a restriking-mechanism-equipped hardening apparatus 20 and a tempering furnace 14. In the mold casting apparatus 1, two processes are carried out, namely, a process of pouring into a mold thereof molten metal for metal-based parts and a process of releasing from the mold a cast product when a surface of the product held in contact with the mold turns into a shell-like solidified Layer and is in a temperature range that allows hardening.

As described in detail below with reference to FIG. 3, the restriking-mechanism-equipped hardening apparatus 20 is provided for wholly or locally, hardening the cast product released from the mold by spraying a cooling agent at the whole or part of the product, or soaking the product into a liquid of cooling agent. This is followed by subjecting the cast product to a tempering treatment in the tempering furnace 14 for increasing the toughness of the product.

Figure 3:
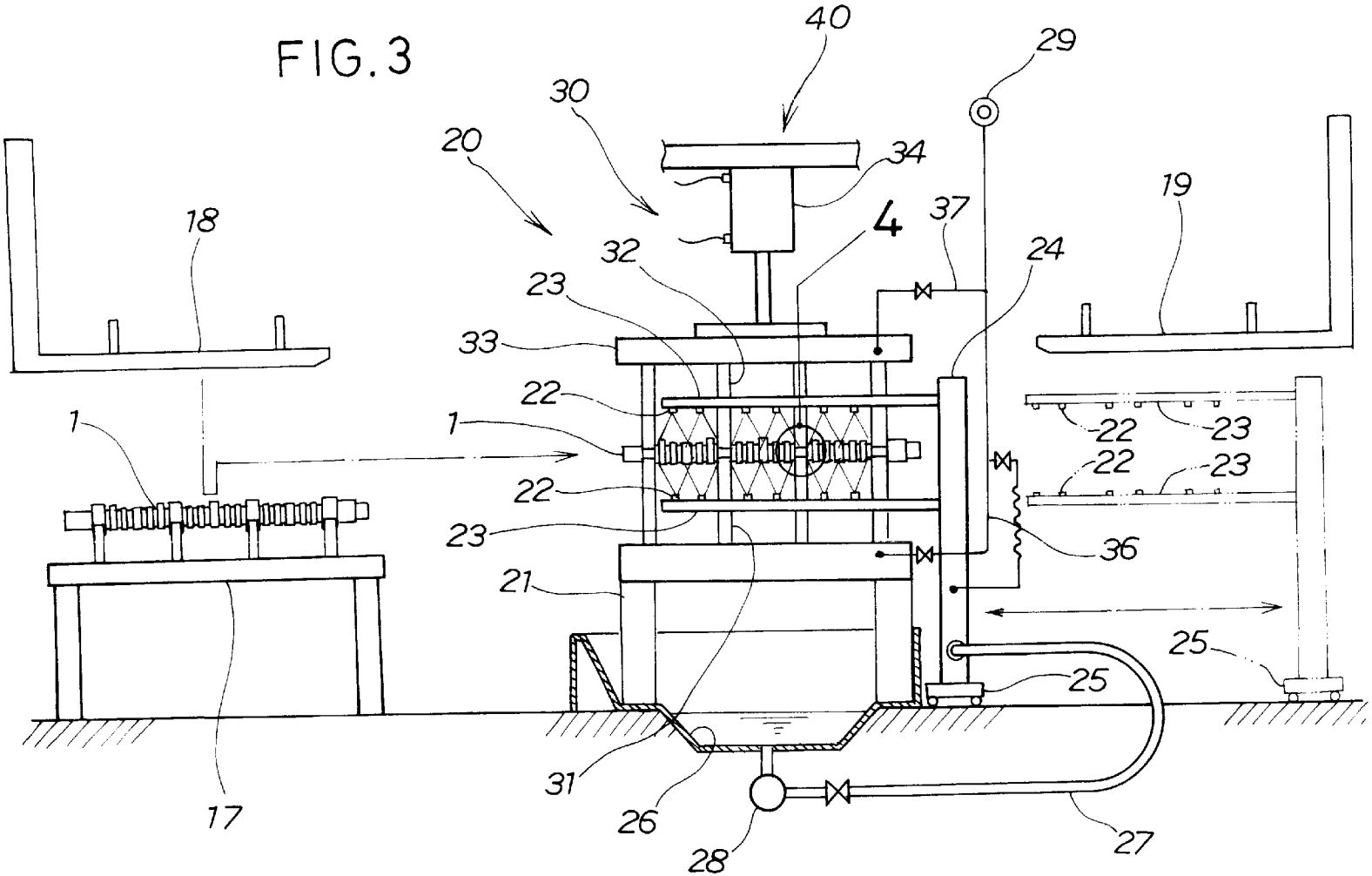
FIG. 3 illustrates the principle of a preferred form of a restriking-mechanism-equipped hardening apparatus according to the present invention.

Turning now to FIG. 3, the restriking-mechanism-equipped hardening apparatus 20 comprises a frame 21, a plurality of spray nozzles 22 for spraying a cooling agent, a plurality of headers 23 for supporting the spray nozzles 22, a support column 24 for supporting the headers 23, a bogie 25 for supporting the support column , 4, a collecting pan 26 for collecting a sprayed cooling agent, a pump 28 for pressurizing the cooling agent to feed the latter through a flexible hose 27 to the support column 24, an air compressor 29 for feeding air to the support column 24, and a partial slow cooling apparatus 40 including a restriking mechanism 30. The support column 24 also serves as a conduit for allowing passage of the cooling agent and air therethrough.

The restriking mechanism 30 comprises a plurality of cooling blocks or racks 31 vertically disposed on the frame 21 for supporting the journal portions of the camshaft 1, a plurality of cooling blocks or constraining pawls 32 disposed above the racks 31 in opposed relation to each other, a frame 33 vertically movable for supporting the constraining pawls 32, a hydraulic cylinder 34 for vertically moving the frame 33, and air hoses 36, 37 for feeding air to the racks 31 and constraining pawls 32.

The camshaft 1 taken out of the cutting apparatus is temporarily laid on a laying table 17 and then transported to the hardening apparatus 20 by means of a loader 18. After hardening, the spray nozzles 22 are pulled away to a position indicated by a phantom line through the bogie 25, whereafter the camshaft 1 is pulled out from the hardening apparatus 20 by means of an unloader 19.

Figure 4:
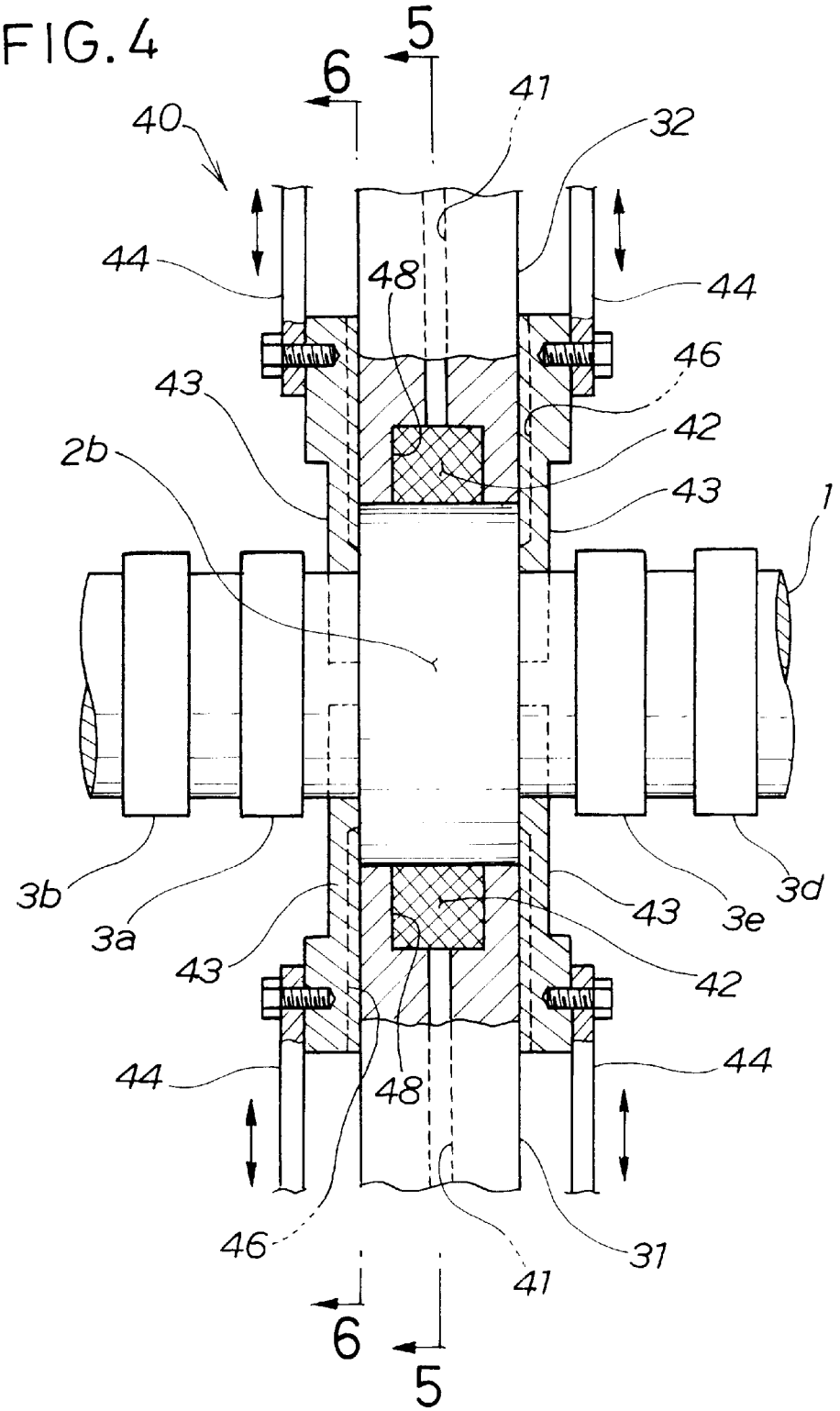
FIG. 4 is an enlarged view of a portion encircled by numeral 4 of FIG. 3

Referring next to FIG. 4, the partial slow cooling apparatus 40 is designed to slowly cool part of the camshaft 1 and includes the restriking mechanism 30. A cooling agent passage 41 is formed in each rack 31 and includes at an outlet thereof a recessed portion 48 for receiving a porous block 42 in such a manner that it is held in contact with the journal portion 2*b* of the camshaft 1. The porous block 42 is made of a porous material so that the cooling agent (desirably air, a nitrogen gas, or a mixed mist of air and water) is appropriately dispersed and sprayed onto the journal portion 2*b* in mild streams. Designated by reference numeral 43 are side masks each serving as an insulating plate for preventing the cooling agent from flowing out to the cam portions 3*a,* 3*e*. Without the side masks 43, 43, the cooling agent hits the cam portions 3*a,* 3*e* to thereby cool the latter down to a temperature lower than a temperature acceptable for hardening. This inconvenience can be prevented by the side maskings 43, 43. The side maskings 43 are vertically moved by vertical movement of links 44.

Similarly, the constraining pawls 32 include a cooling agent passage 41, a recessed portion 48, a porous block 42, side maskings 43, 43 and links 44, 44.

Figure 5:
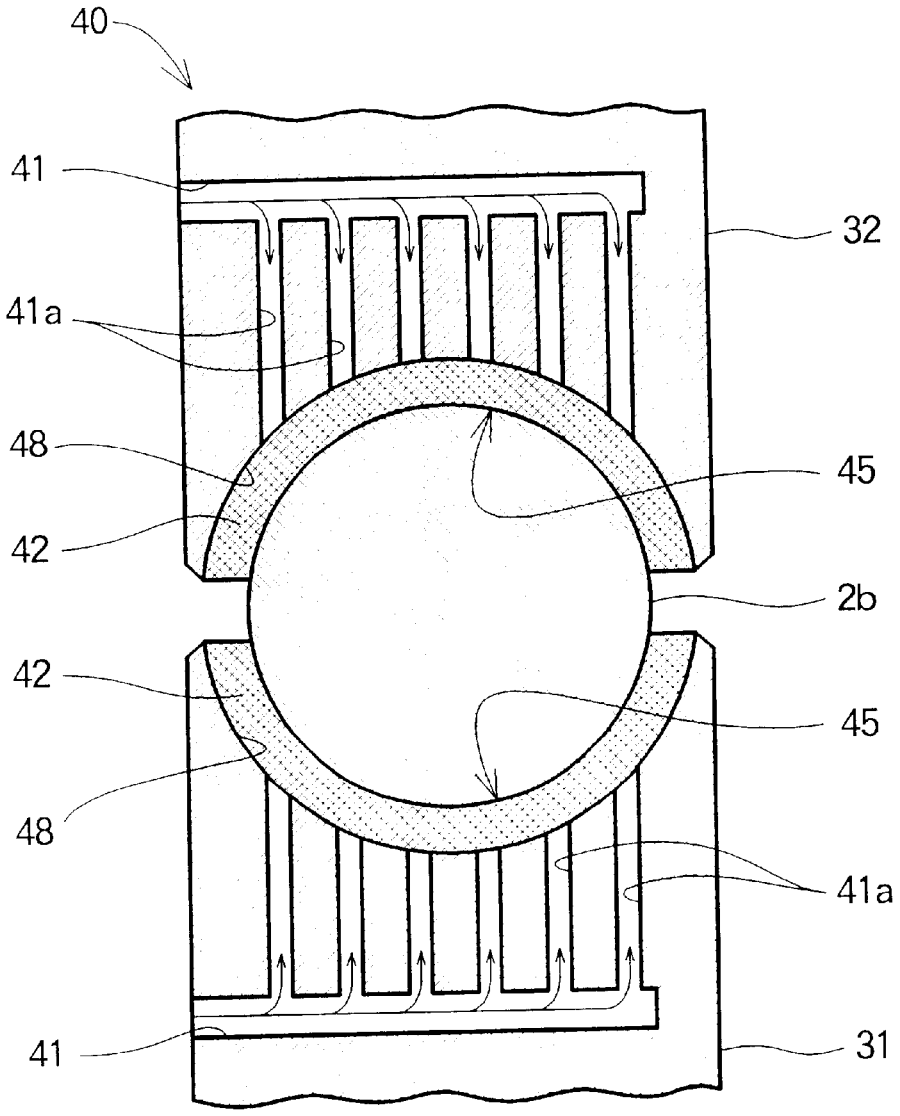
FIG. 5 is a cross-sectional view taken along line 5—5 of FIG. 4.

As shown in FIG. 5, the upper and lower porous blocks 42 have a curved surface 45 which extends along an outer peripheral surface of the journal portion 2*b*. The curved surface 45 is placed in tight contact with the journal portion 2*b*. The cooling agent passage 41 is branched into a plurality of distributing paths 41*a* extending to the porous block 42. By virtue of the branching of the cooling agent passage 41 and the dispersing action of the porous block 42, the cooling agent is moderately dispersed, whereby the journal portion 2*b* is cooled uniformly.

When the cooling agent is air, which is inherently highly dispersive, only the branched distributing paths 41*a* may be provided with the porous block 42 omitted.

The porous material forming the porous block 42 may be either one of metallic fibers, ceramic fibers, metal-ceramic mixed-spun woven fabrics, metal-ceramic mixed-spun unwoven fabrics, metallic sinters, ceramic sinters and metal-ceramic-mixed sinters.

Figure 6:
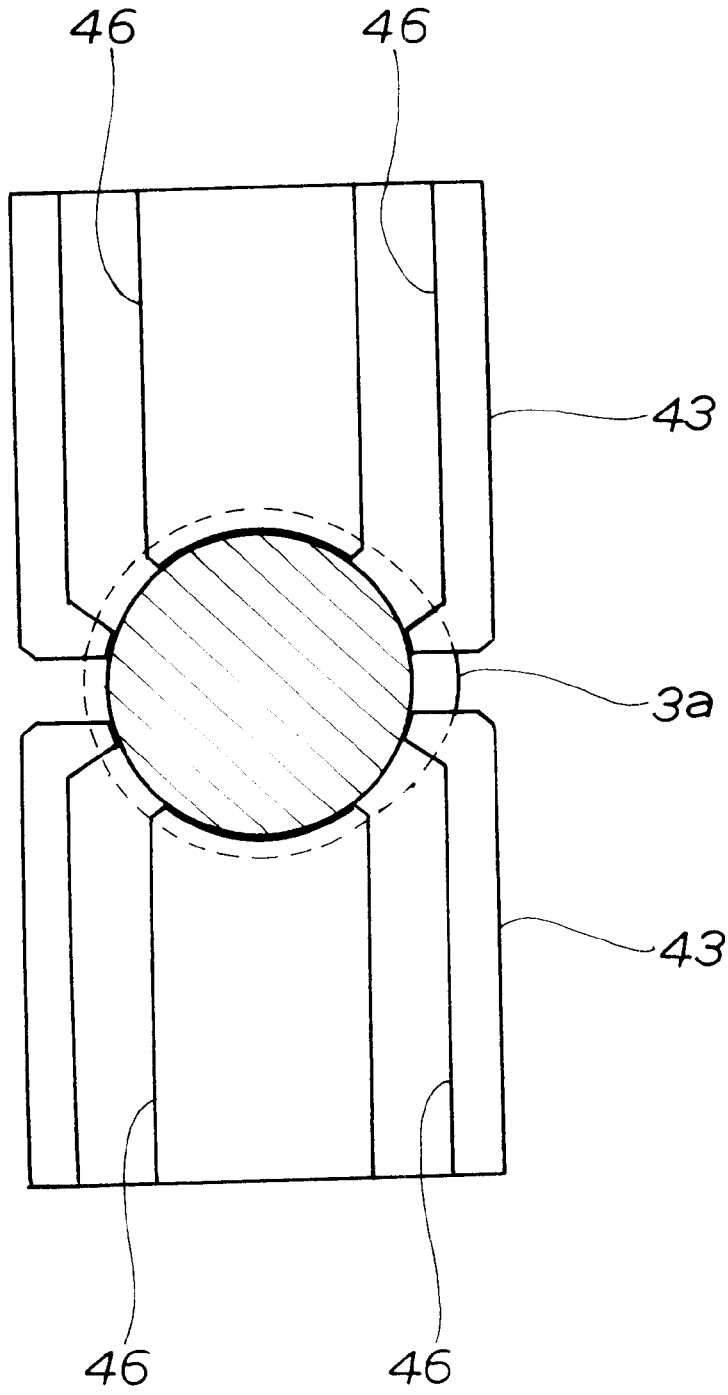
FIG. 6 is a cross-sectional view taken along line 6—6 of FIG. 4.

As can be appreciated from FIG. 6, each of the upper and lower side maskings 43, 43 has a cooling agent discharge passage 46. Without these discharge passages 46, the cooling agent, sprayed onto the journal portion 2*b* through the porous block 42 shown in FIG. 5, flows, groping for ways out, toward the cam portion 3*a,* as shown in FIG. 6, thereby undesirably descending the temperature of the cam portion 3*a*. Such a fear can be avoided by arranging the cooling agent to be discharged upwardly or downwardly through the cooling agent discharge passages 46. Thus, it is desirable to provide the cooling agent discharge passages 46 as illustrated.

Figure 7:
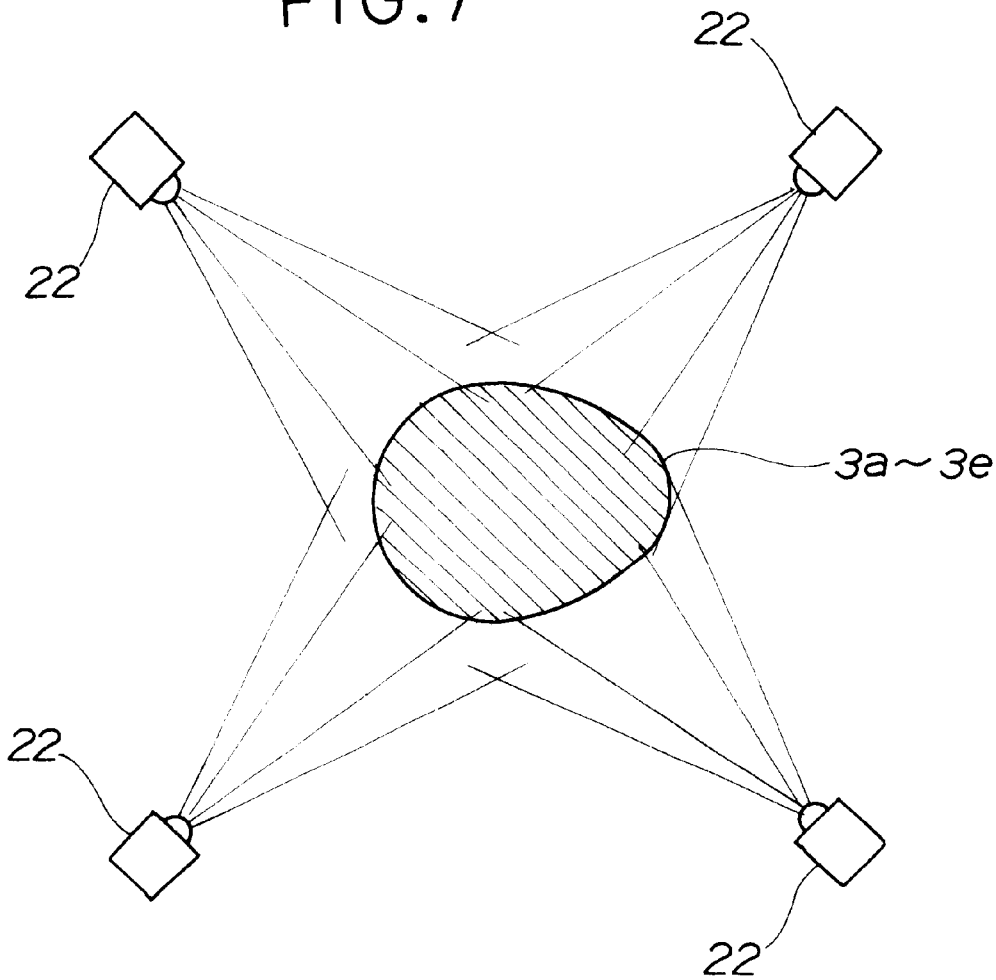
FIG. 7 illustrates the positioning of spray nozzles with respect to a cam portion.

The cooling agent is sprayed onto the cam portions 3*a*–3*e* by means of the spray nozzles 22, as shown in FIG. 7. To uniformly cool the cam portions 3*a*–3*e,* the spray nozzles 22 are positioned around the cam portions 3*a*–3*e* so that the spraying can be achieved from four different directions angularly spaced 90° from each other.

The spray nozzles 22 are of the type called air atomizing mist nozzles which, using air, turn a cooling agent in the form of liquid such as water into mist and allows for changing the cooling rate by varying the liquid-air ratio. Specifically, the more the liquid increases, the higher the cooling rate becomes. Conversely, the more the air increases, the lower the cooling rate becomes.

Figure 8:
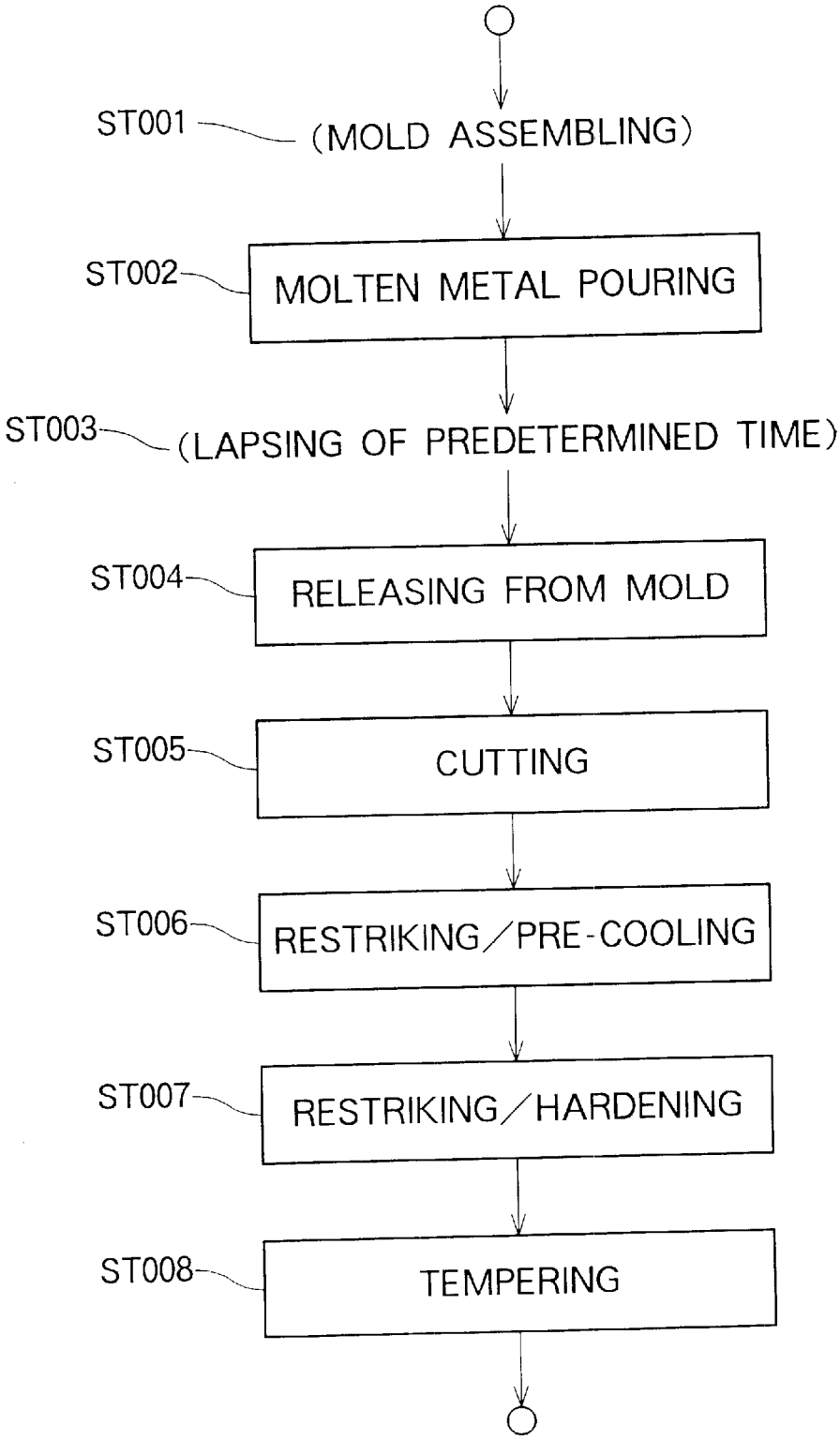
FIG. 8 is a flowchart of a preferred embodiment of heat treatment of a mold cast product; according to the present invention.

With reference to the flowchart of FIG. 8, discussion will be made next as to an operation of the heat treatment of the mold cast product in the restriking-mechanism-equipped hardening apparatus arranged as explained above.

Step (hereinafter simply "ST") 001: mold members are assembled.

ST 002: molten metal containing the material components of the embodiment shown in Table 1 is poured into the assembled mold.

ST 003: the molten metal poured into the mold gets cooled first in its surface layer held in contact with the mold; the surface layer starts to solidify at the temperature of 1,150 to 1,200° C. to provide a shell-like solidified layer with the inside of the molten metal remaining unsolidified. The depth of the solidified layer, which grows as time lapses, is allowed to grow to such an extent that it does not become ruptured. The time for allowing the growth is controlled.

ST 004: after lapse of a predetermined time, the mold is disassembled so that the mold cast product can be taken out.

ST 005: a runner and a fin are quickly cut off.

ST 006: the cast product is subjected to restriking and pre-cooling processes. ST 006 will be described in more detail below with reference to FIGS. 9A, 9B and 10.

Figure 9A:
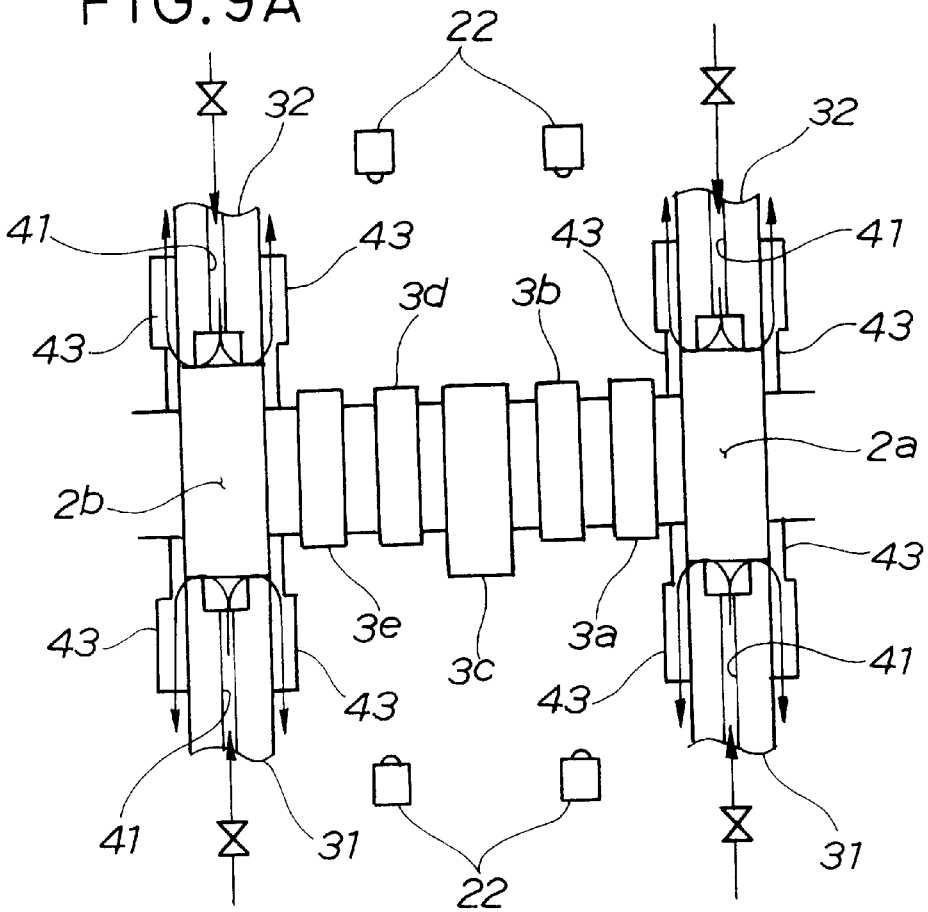
FIGS. 9A and 9B illustrate an operation of the embodiment in which a journal portion is pre-cooled as it is held in a constrained state.

As shown in FIG. 9A, the journal portions 2*a* and 2*b* are placed on the racks 31, 31 and pressed hard by the restriking pawls 32, 32 to thereby correct warps occurring upon release thereof from the mold.

Thereafter, air is flown via the cooling passages 41 onto the journal portions 2*a,* 2*b* as shown by arrows to forcedly cool the journal portions 2*a,* 2*b*. Owing to the insulating action of the side masks 43, there is no fear that air will escape sideways. At this; time, the spraying by the nozzles 22 is interrupted.

Figure 9B:
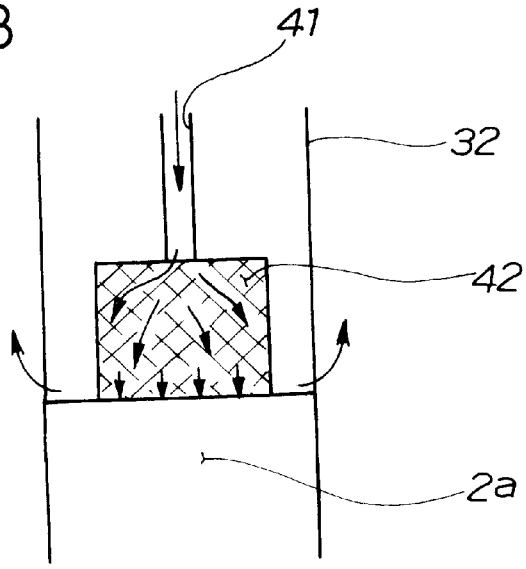

The journal portion 2*a* is cooled softly by air dispersed moderately through the porous block 42, as shown in FIG. 9B. The same applies to other journal portions 2*b* to 2*d* not illustrated.

Figure 10:
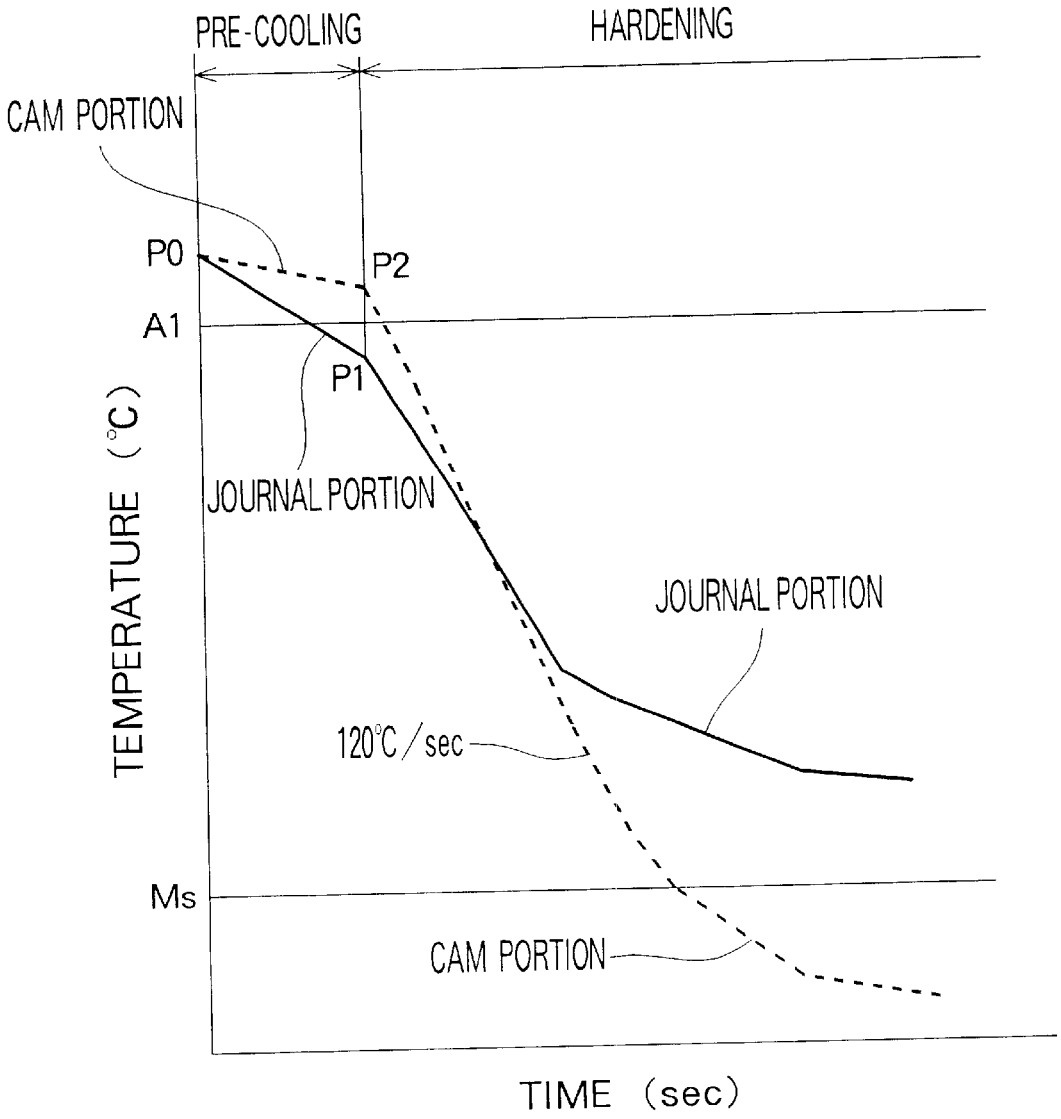
FIG. 10 is a graph illustrating cooling curves of a camshaft as a product mold cast in accordance with the present invention.

Shown in FIG. 10 are cooling curves of the cast product, camshaft. Time is shown on the horizontal axis while temperature is shown on the vertical axis. The solid-lined curve represents journal portion surface temperatures. The broken-lined curve represents cam portion surface temperatures. Reference character A1 on the vertical axis represents a transformation point which is 780 to 800° C. when Si component is 3.37 to 4.34%. Reference character Ms represents a martensite point which is approximately 180° C.

Pre-cooling is started at point P0 (e.g., 950 to 1,050° C.) which is higher than the temperature of A1 and terminated when the journal portions are cooled forcedly by air down to point P1 (e.g., 700 to below 780° C.) which is lower than the temperature of point A1. In contrast, though its temperature drops slightly as a result of being subjected to natural cooling, the cam portion is kept in a temperature range higher than the temperature of A1.

Turning back to FIG. 8, restriking and hardening processes or operations are carried out at ST 007. This correction is performed to remove warps occurring in the cast product upon release of the latter from the mold, as well to correct the distortion arising from the rapid cooling of the product. Next, the hardening operation will be explained in detail with reference to FIG. 11.

Figure 11:
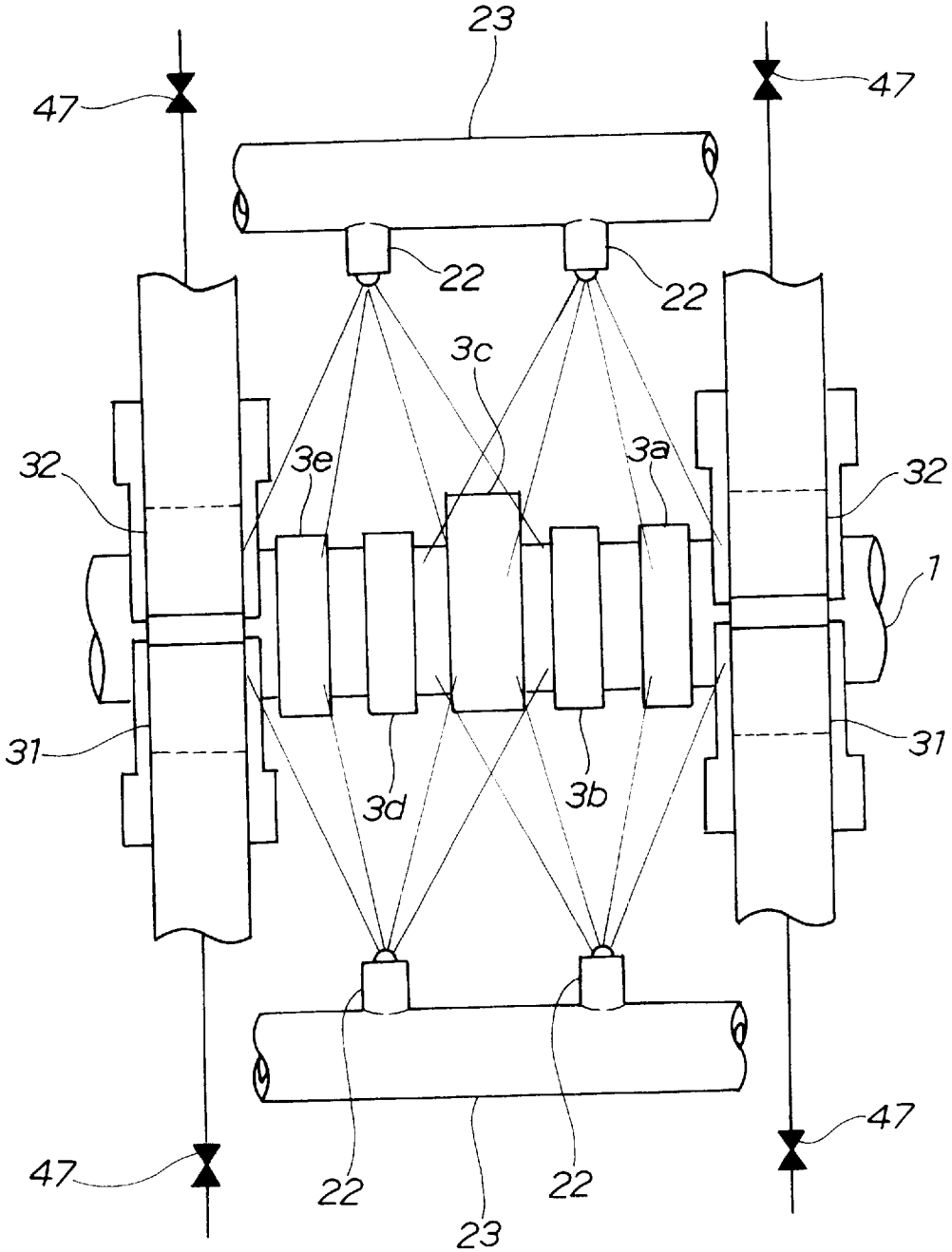
FIG. 11 illustrates an operation for restriking and hardening according to the present invention.

As shown in FIG. 11, the camshaft 1 is constrained by the racks 31, 31 and pawls 32, 32. Then, valves 47 are closed to interrupt the supply of air to the racks 31, 31 and pawls 32, 32. This is followed by spraying a cooling agent in the form of mist onto the cam portions 3*a* to 3*e* to thereby rapidly cool the latter.

At the outset of cooling, the cam portion surface has a temperature higher than A1 (780 to 800° C.). Pressurized air of 2–4 kgf/cm$^2$ and water of 4–5 kgf/cm$^2$ in the amount of 180–400 lit/hr are fed to the spray nozzles 22 so that a cooling rate of 120° C./min is established at the outset of cooling.

Turning back to FIG. 10, the cam portion is rapidly cooled down from point P2, which is higher than A1 (780–800° C.) so that its temperature passes over point Ms (approx. 180° C.), whereafter its austenite turns into martensite. This initiates the hardening of the cam portion.

In contrast, the journal portions are not hardened, because their cooling begins at P1 which is lower than A1. This is more so when the curve of those portions does not pass over point Ms.

That is, one important feature of the embodiment being described is that the journal portions, which are desired not to be hardened, are forcedly held below A1 in the pre-cooling process to thereby prevent the hardening of those portions. Owing to such processing, there is no fear of the journal portions being hardened even when their temperature is assumed to have dropped to below Ms.

Referring back to FIG. 8, tempering is carried out at ST 008. The tempering is a heat treatment incidental to the hardening and may be performed to increase the toughness of the cast product when this is deemed necessary.

Figure 12:
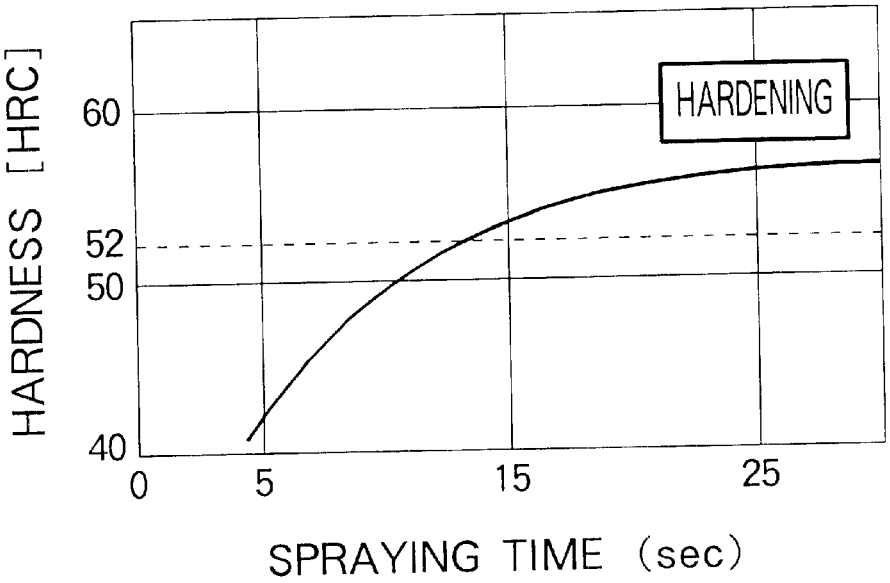
FIG. 12 is a graph illustrating the hardness resulted from the hardening in accordance with the present invention.

Reference is made next to FIG. 12 which is a graph showing the hardness of the described embodiment hardened in accordance with the present invention. A spraying time is shown on the horizontal axis while HRC (Rockwell hardness, C scale) is shown on the vertical axis. Target hardness in the embodiment is 52. It has been confirmed that the target hardness can be obtained when the spraying time is set to be more than 15 seconds with the spray nozzles being arranged as described above.

Figure 13:
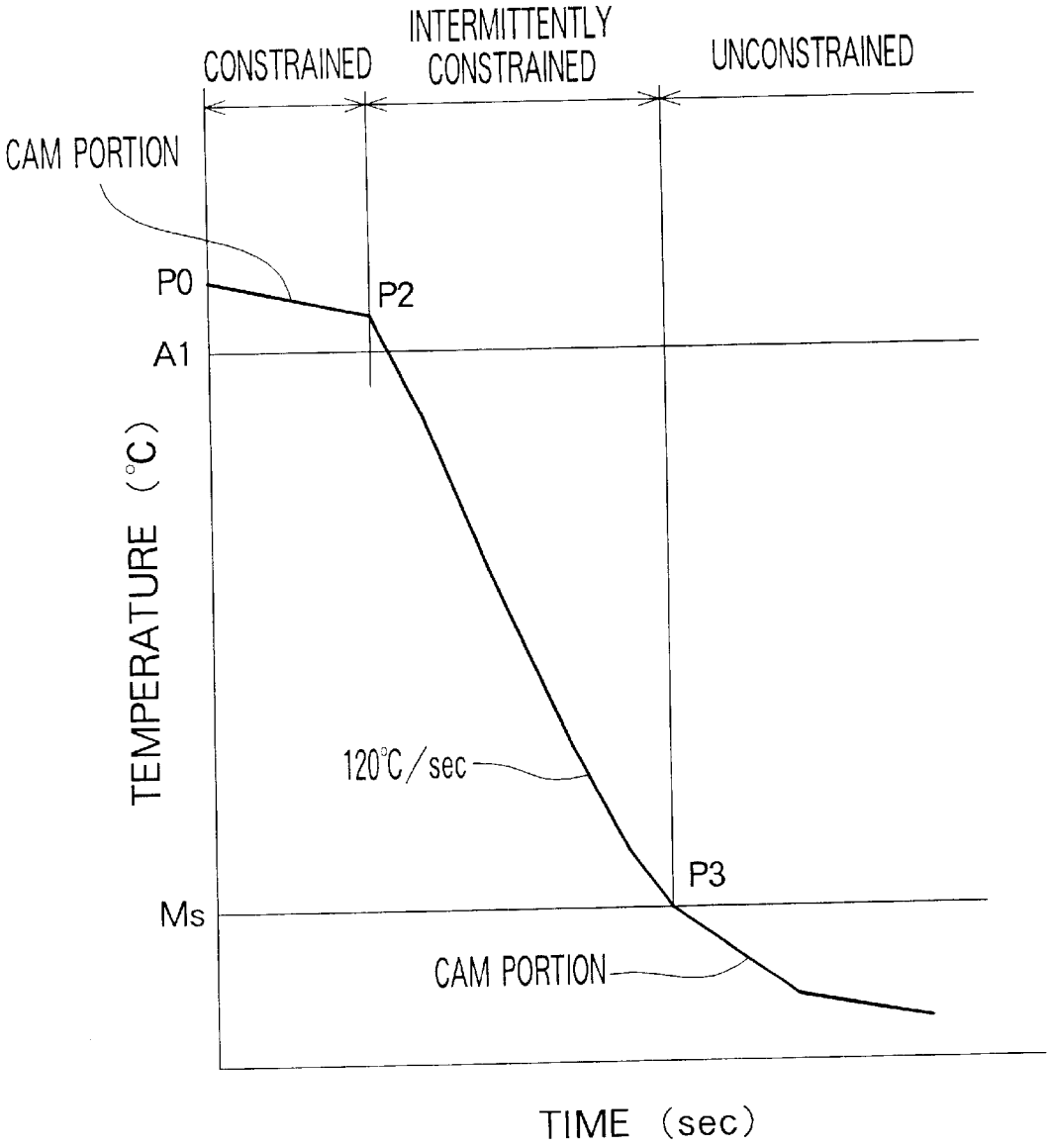
FIG. 13 is a graph illustrating cooling curves of the cam portion taken when the camshaft; is cooled as it is intermittently constrained.

FIG. 13 is a graph showing a cooling curve taken of the cam portion as it is constrained, intermittently constrained and unconstrained. Point P2 on the curve corresponds to the starting point of the forced cooling while point P3 represents the intersection with the start temperature (Ms point) of the martensitic transformation.

In the described embodiment, the cast product is corrected in its configuration when it is positioned between P0 and P2, that is, as it is released from the mold. At this time, the workpiece has a temperature higher than point A1 and hence is soft, whereby its configuration correction can be performed easily.

Between points P2 and P3, the cam portion is forcedly cooled while repeating alternate constraining and non-constraining. This repetition of constraining and non-constraining is called intermittent constraining. For example, the constraining lasts 2 seconds while the non-constraining lasts 0.5 second. Thus, when the required time between points P2 and P3 is 10 seconds, constraining and non-constraining is repeated four times.

Since deformation of the camshaft 1 is controlled while it is constrained as explained above, bending of the camshaft can be avoided. In addition, the camshaft 1 is left unconstrained to allow shrinkage thereof, it becomes possible to prevent the camshaft from cracking.

Below point P3, the case product is kept unconstrained. In other words, it is not necessary to constrain the product, because the starting temperature of the martensitic transformation is 180° C. and thermal deformation occurring below that temperature is subtle.

At a temperature below the starting temperature of the martensitic transformation, austenite is transformed into martensite and metallurgical expansion begins. Accordingly, it is desirable to avoid restricting the transformational expansion by keeping the product constrained. This will provide a cast product of excellent quality which is devoid of cracks.

Figure 14:
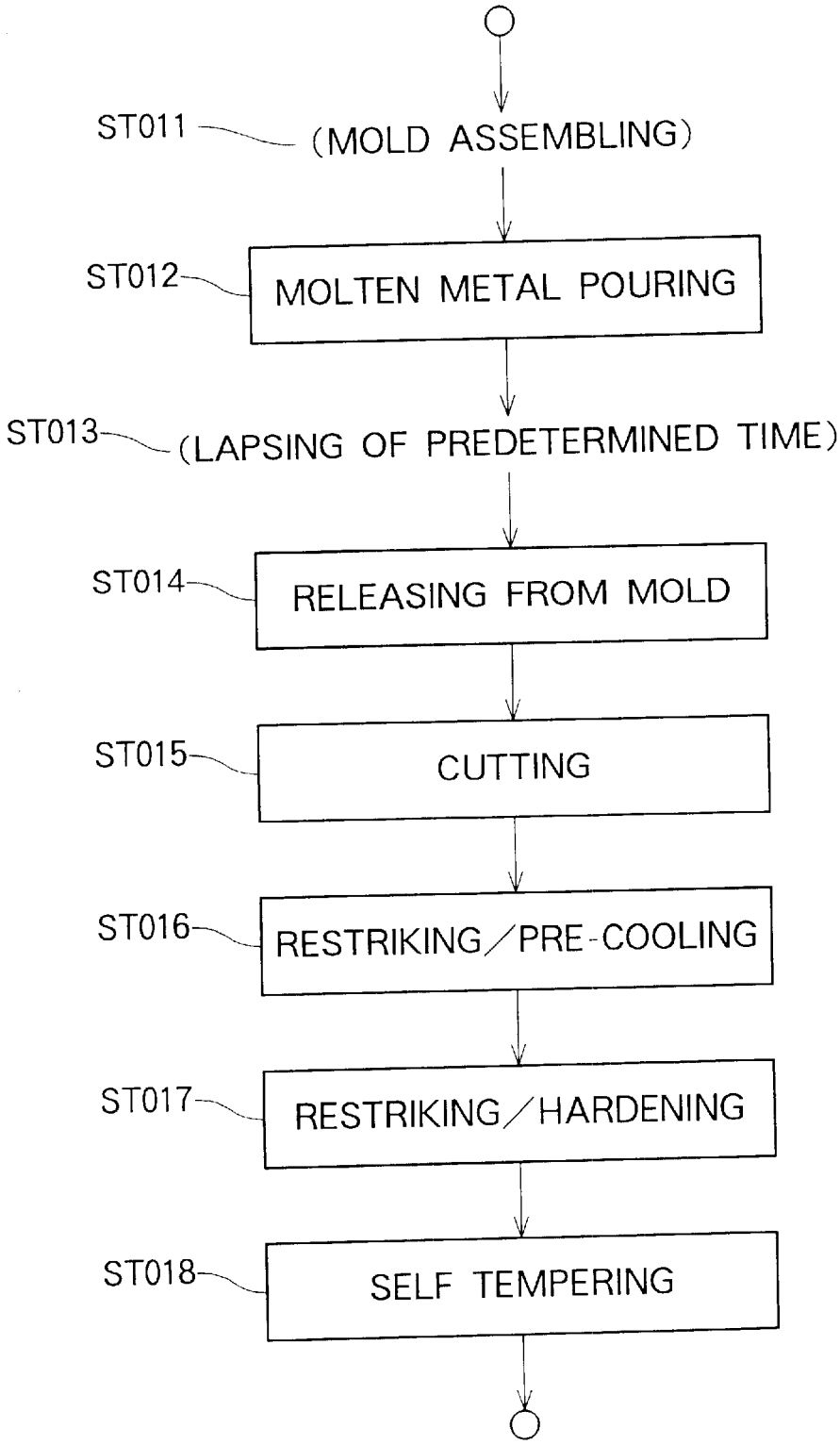
FIG. 14 is a flowchart of heat treatment for self tempering which is an alteration of the embodiment shown in FIG. 10.

Referring to FIG. 14, discussion will be made next as to heat treatment according to an altered embodiment of the present invention. In this altered embodiment, ST 011–ST 017 are identical to ST 001–ST 007 of FIG. 8 and hence their description will be omitted. The altered embodiment differs from the heat treatment of FIG. 8 in that it has ST 018 where self tempering is performed compared to tempering (ST 008). Therefore, detailed description will be made of ST 018 below.

Figure 15:
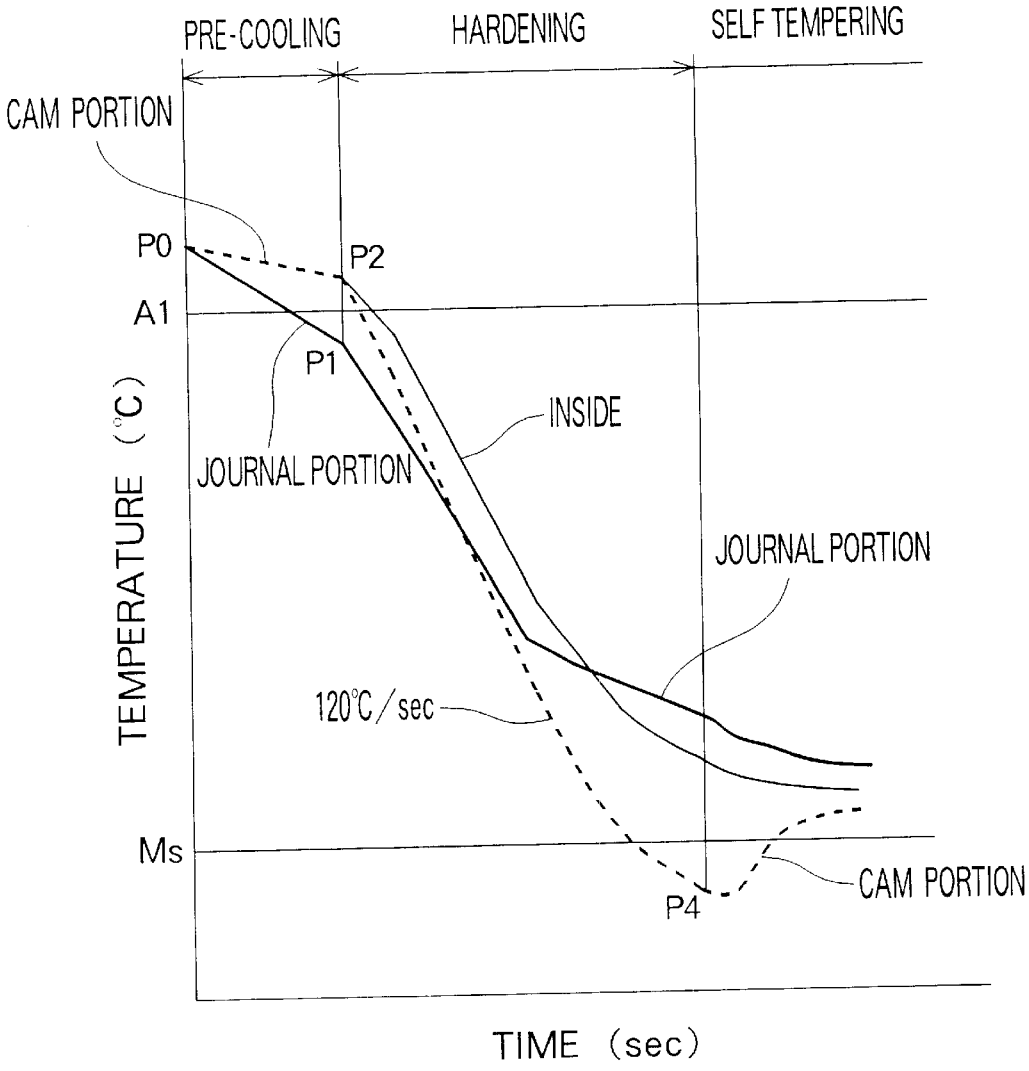
FIG. 15 is a graph illustrating cooling curves of a product obtained in accordance with the altered embodiment of FIG. 14.

As shown in FIG. 14, self tempering is carried out at ST 018. More specifically, as shown in FIG. 15, when the temperature of the cam portion drops to point P4 (e.g., 160 to 180° C.) which is lower than the temperature of Ms, the rapid cooling of the cam portion as from point P2, which is higher than the temperature of A1, is interrupted. At this time, residual heat, which is higher than the temperature of the surface layer of the cam portion, is transmitted from inside the cam portion and journal portion to the cam portion surface layer, whereby the temperature of the cam portion rises to one higher than a low-temperature tempering temperature. This makes the cam portion annealed. Tempering by using such residual heat of the workpiece may be called self tempering. Consequently, the tempering furnace 14 as shown in FIG. 2 is not required in the altered embodiment.

Figure 16:
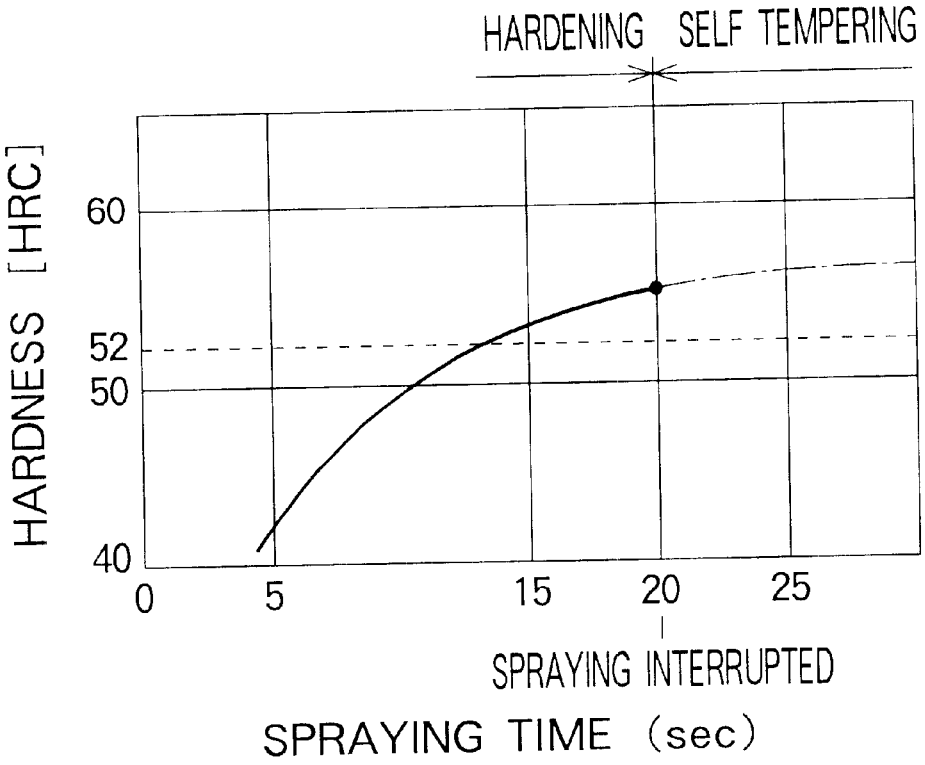
FIG. 16 is a graph illustrating the hardness obtained by hardening in accordance with the altered embodiment of FIG. 14.

Reference is made next to the graph of FIG. 16, illustrating the hardness obtained by hardening in accordance with the altered embodiment. In the altered embodiment, target hardness is 52 as in the previously described embodiment. It has been confirmed that the target hardness can be obtained by setting the spraying time to be 15 seconds or more with the spray nozzles positioned as in the firstly-explained embodiment. The spraying may thus be interrupted in 20 seconds including a spare extra time of 5 seconds, and then self tempering is performed using the residual heat. The duration of interruption of spraying may be changed depending on the configuration and dimensions of the workpiece and the amount of the sprayed cooling agent. The duration is not limited to 20 seconds in the present invention.

Figure 17:
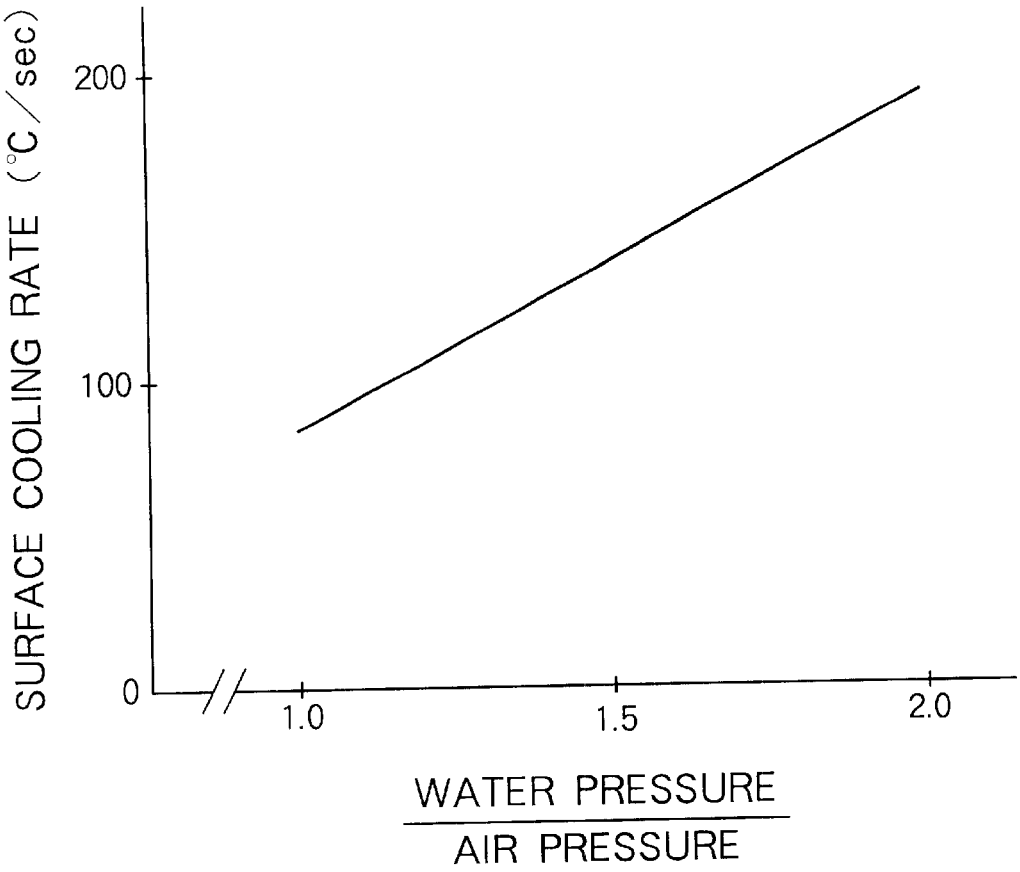
FIG. 17 is a graph illustrating a relationship between a cooling agent and a cooling speed in the embodiment of FIG. 10.

Reference is now made to FIG. 17 showing a relation between the cooling agent and a cooling rate. Shown on the horizontal axis is an air pressure versus water pressure ratio. A surface cooling rate is shown on the vertical axis.

When water pressure/air pressure=1.0, the surface cooling rate is approximately 90° C./sec. When water pressure/air pressure=1.5, the surface cooling rate is 140° C./sec. When water pressure/air pressure=2.0, the surface cooling rate is 190° C./sec. The higher the water pressure becomes, the more the amount of water increases, thereby providing a larger cooling rate. Since the cooling rate can thus be controlled only by changing the water pressure versus air pressure ratio, minute control of the cooling rate can be effected easily.

Generally, the larger the cooling rate becomes, the deeper the hardening reaches. The cooling rate may thus be determined in correspondence with a requested depth of hardening. It also becomes possible to obtain a bainitic structure, which is a non-martensitic structure, or a fine pearlite structure. The bainitic structure has high viscosity while the fine pearlite structure exhibits high strength. The bainite and pearlite do not need to be tempered.

The minute control of the cooling rate makes it possible to easily obtain a diversity of metallic structures.

What can be treated by the inventive method are automobile parts such as a camshaft, a rocker arm and a knuckle arm, and other iron-based parts similar thereto.

As one desires, the cutting apparatus 12 of FIG. 2 may be repositioned. Similarly, ST 005 of FIG. 8 and ST 015 (cutting process) of FIG. 14 may be transferred to other steps.

Figure 18:
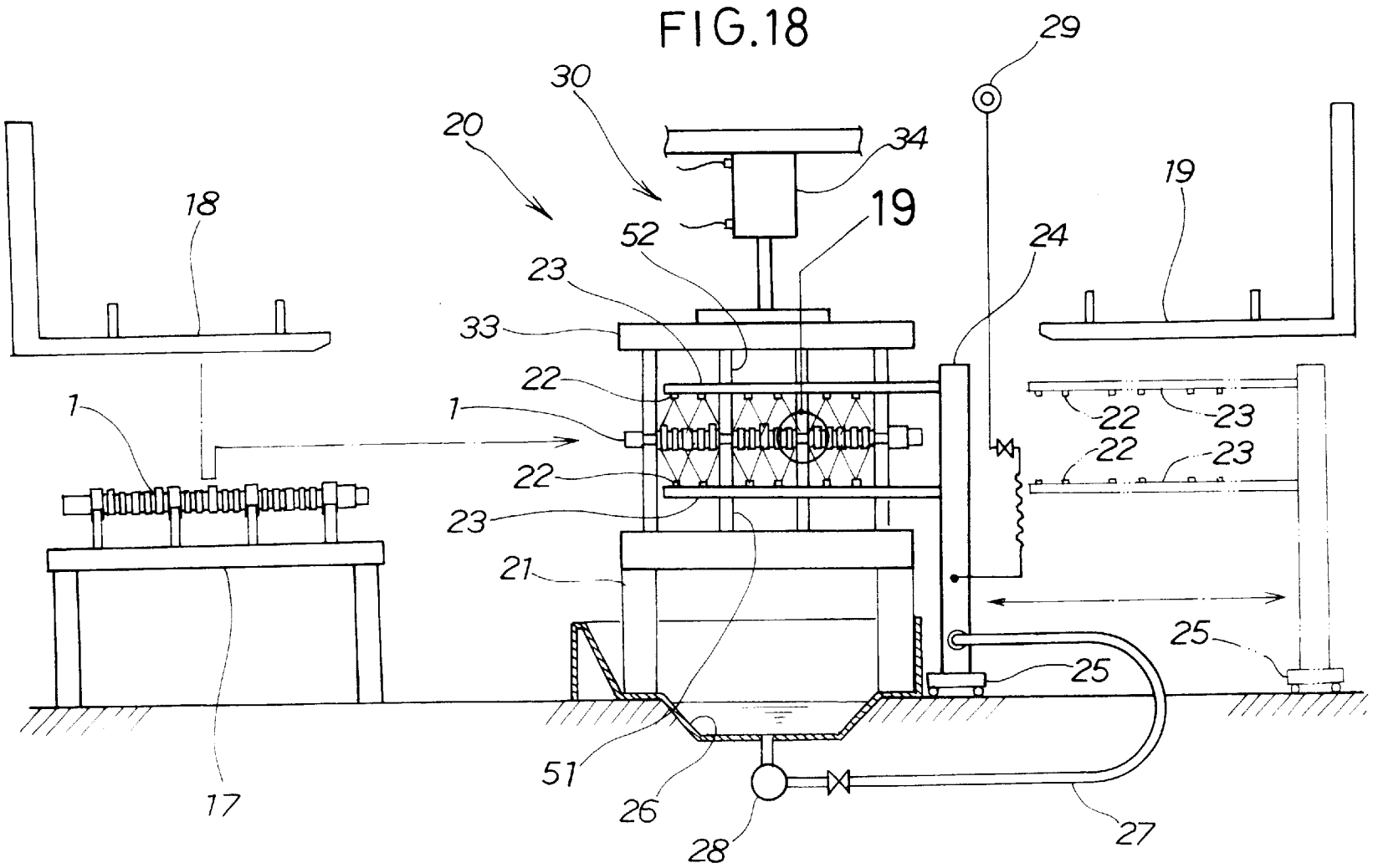
FIG. 18 illustrates the principle of a separate embodiment having a restriking mechanism corresponding to that of FIG. 3.
Figure 19:
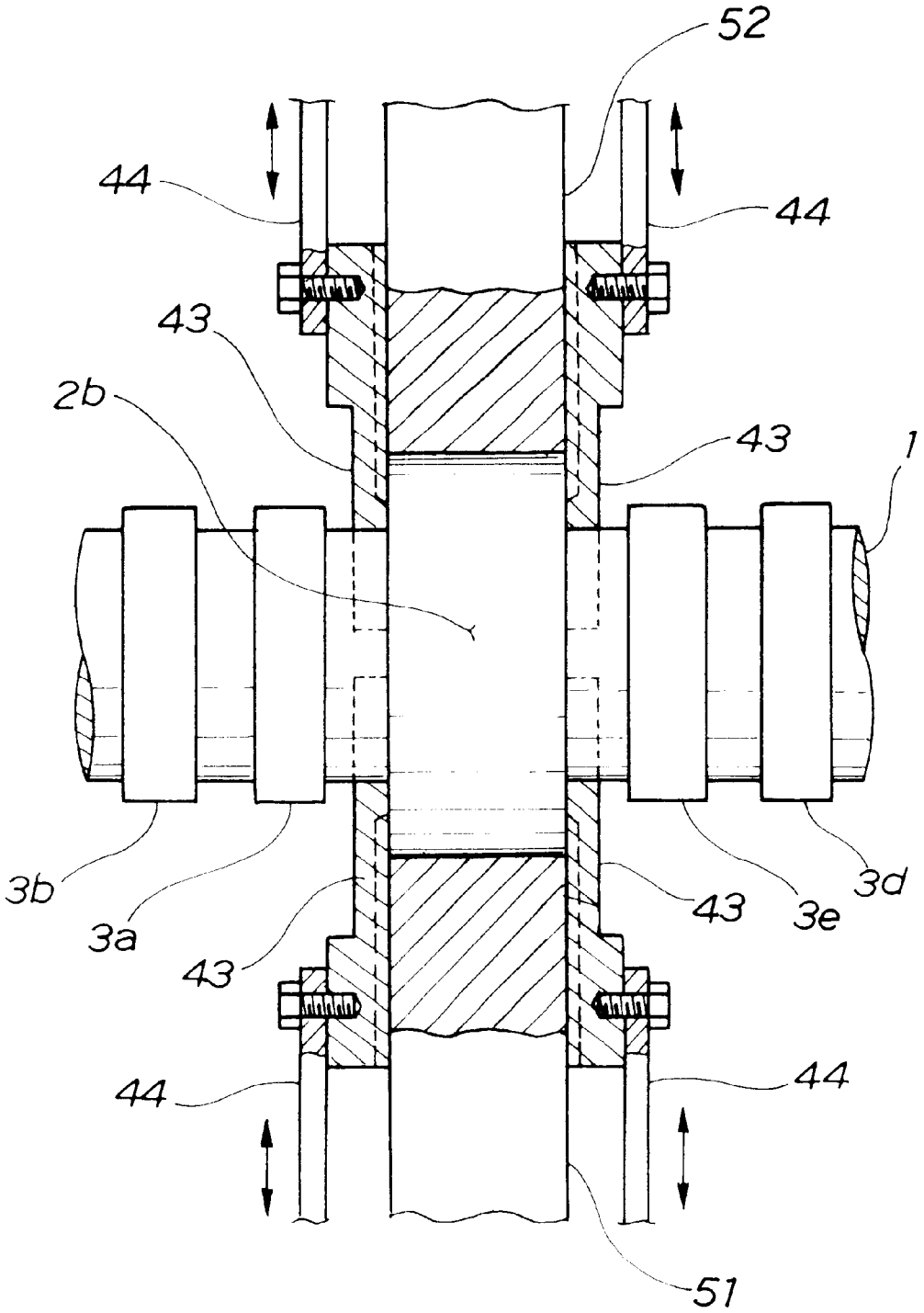
FIG. 19 is an enlarged view illustrating, partially in section, a portion, encircled by numeral 19, of FIG. 18, with a cooling block removed.

FIGS. 18 and 19 correspond to FIGS. 3 and 4 but illustrate an embodiment for achieving coexistence of a hardened portion and an unhardened portion in a single cast product, with an altered embodiment of the restriking-mechanism-equipped hardening apparatus of FIG. 2.

In this embodiment, the rack 51 for supporting the journal portions of the camshaft 1 and the constraining pawl 52 also serve as the masks for enclosing the journal portions. No cooling passages are formed in the rack 51 and constraining pawl 52. No porous block is also provided. The embodiment being described differs from the previously explained embodiment in these respects. Consequently, no air hose for supplying air is provided in the rack 51 and the pawl 52.

Other arrangements are the same as those of the embodiment explained in relation to FIGS. 3 and 4 and their description will therefore be omitted. The spray nozzles 22 are arranged exactly the same as those of FIG. 7.

Figure 20:
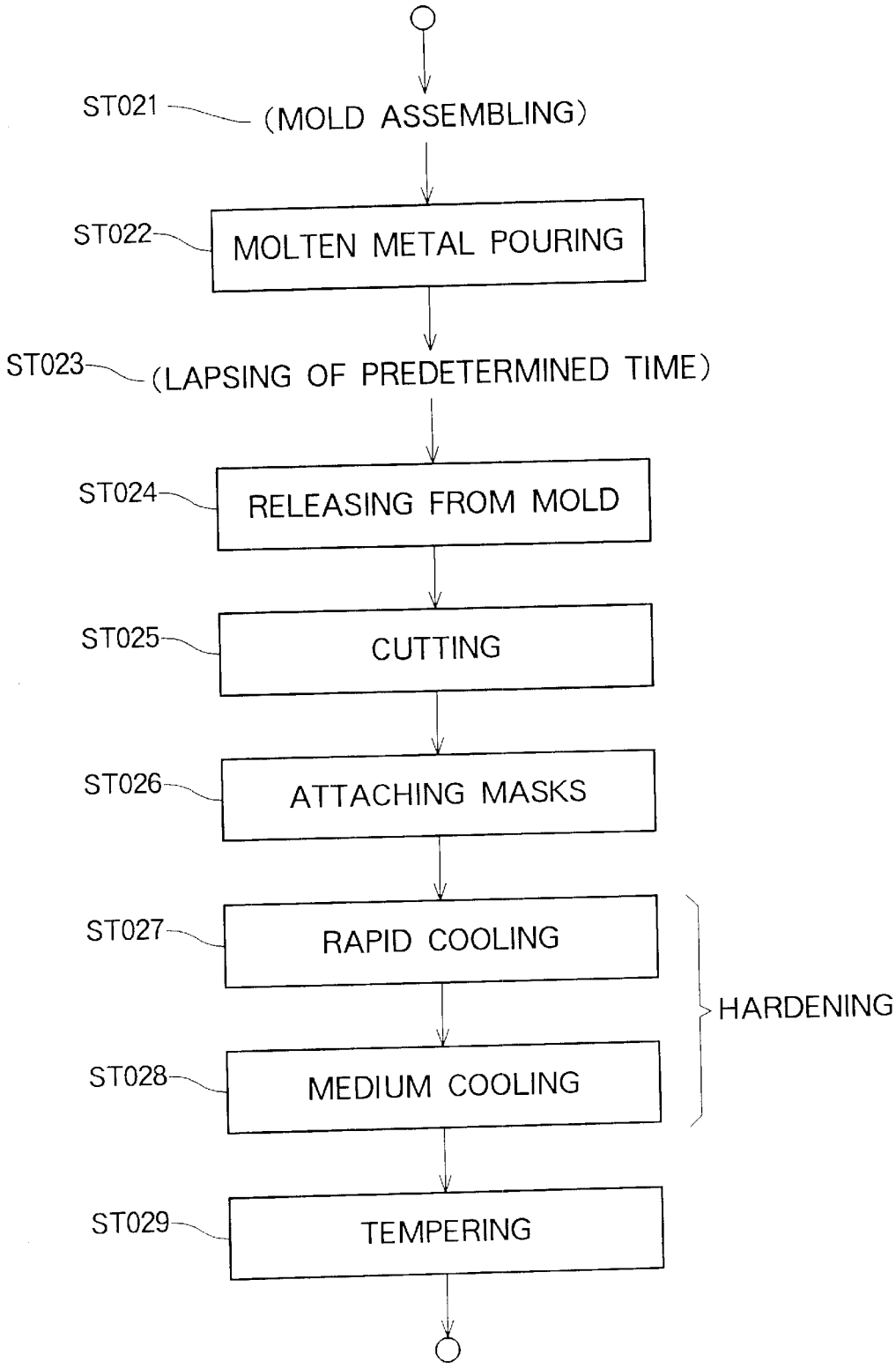
FIG. 20 is a flowchart illustrating a heat treatment process of the separate embodiment shown in FIG. 18.

Heat treatment of the mold cast product of the embodiment just described will be discussed next with reference to FIG. 20.

ST 021: mold assemblage is performed.

ST 022: molten metal of material components equivalent to those of the embodiment shown in Table 1 is poured into the assembled mold.

ST 023: a surface layer of the molten metal is held in contact with the mold and thus first cooled; at a temperature of 1,150 to 1,200° C., the surface layer begins to solidify and finally becomes a shell-like solidified layer with the inside of the molten metal remaining unsolidified; the thickness or depth of the solidified layer grows with the lapse of time and is allowed to grow to such an extent that the layer does not rupture; the time of such growth is controlled.

ST 024: upon lapsing of a predetermined time, the mold is disassembled and the cast product is taken out.

ST 025: a runner and a fin are quickly cut off.

ST 026: the cast product is covered with masks, that is, the camshaft 1 is masked by means of the racks 51, 51 and constraining pawls 52, 52 as shown in FIGS. 18 and 19.

Figure 21:
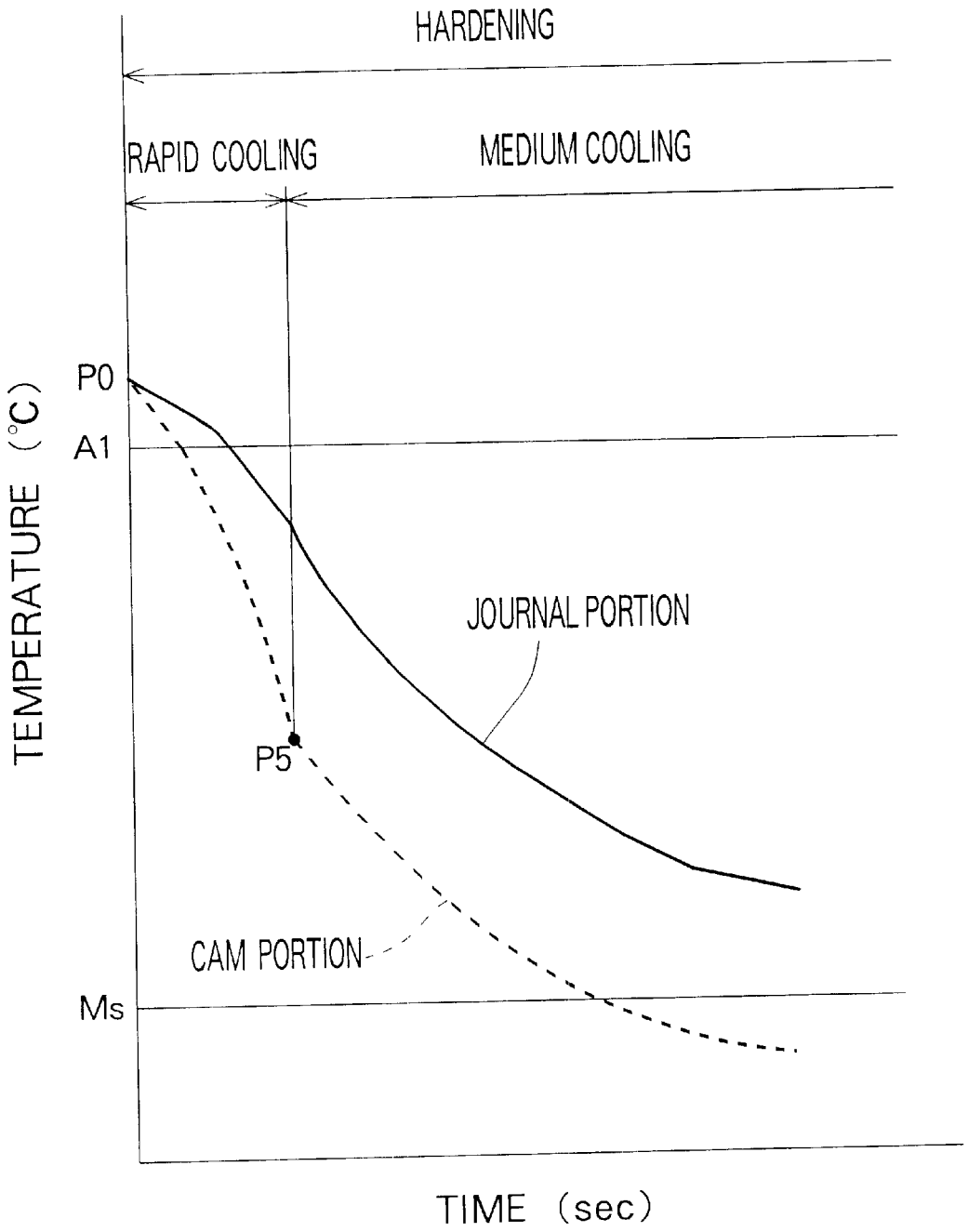
FIG. 21 is a graph illustrating cooling curves of a camshaft produced in accordance with the separate embodiment of FIG. 20.

At ST 027, rapid cooling or quenching is performed while medium rate cooling is performed at ST 028. That is, as shown in FIG. 21, rapid cooling is started at point P0 (e.g., 950 to 1,050° C.). When the temperature of the cam portion comes to point P5 (e.g., approx. 650 to 700° C.) which is lower than the temperature of A1, the cooling is changed to medium cooling. The cooling curve of the camshaft produced in accordance with the embodiment being described is as shown in FIG. 21. The solid-lined curve represents a surface temperature of the journal portion while the broken-lined curve represents a surface temperature of the cam portion. A1 on the vertical axis corresponds to transformation point. When Si components are 3.37 to 4.34, the temperature will be 780 to 800° C. Ms represents a martensite start point which is approximately 180° C.

Figure 22:
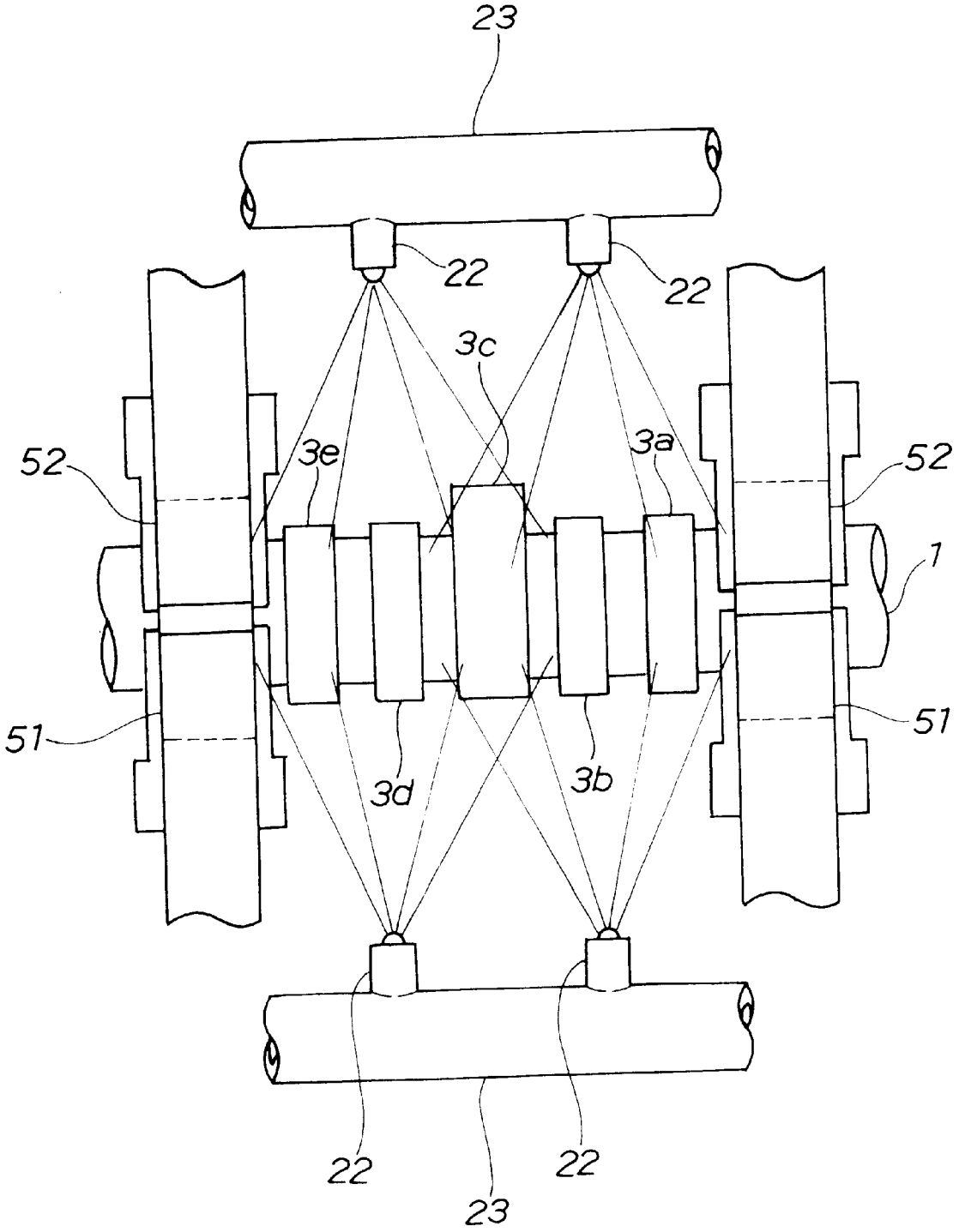
FIG. 22 illustrates an operation of cooling, by means of spray nozzles, a cam portion of a camshaft of in FIG. 18.

Referring to FIG. 22, the treatments of ST 026 to ST 028 will now be described. The camshaft 1 is masked and constrained by the racks 51, 51 and constraining pawls 52, 52, followed by rapidly cooling the cam portions 3*a* to 3*e* by spraying thereonto a cooling agent in the form of mist from the spray nozzles 22. The cam portion surface temperature at the cooling start point P0 is higher than the temperature of the transformation point A1 (780 to 800° C.). The spray nozzles 22 are supplied with, for example, pressurized air of 2–4 kgf/cm$^2$ and pressurized water of 4–5 kgf/cm$^2$ in the amount of 180 to 400 lit/hr to thereby provide the cooling rate of 120° C./sec at the cooling start point.

Turning back to FIG. 20, tempering is performed at ST 029. Tempering is a treatment incidental to hardening and may be performed moderately to increase the toughness of the product.

Figure 23:
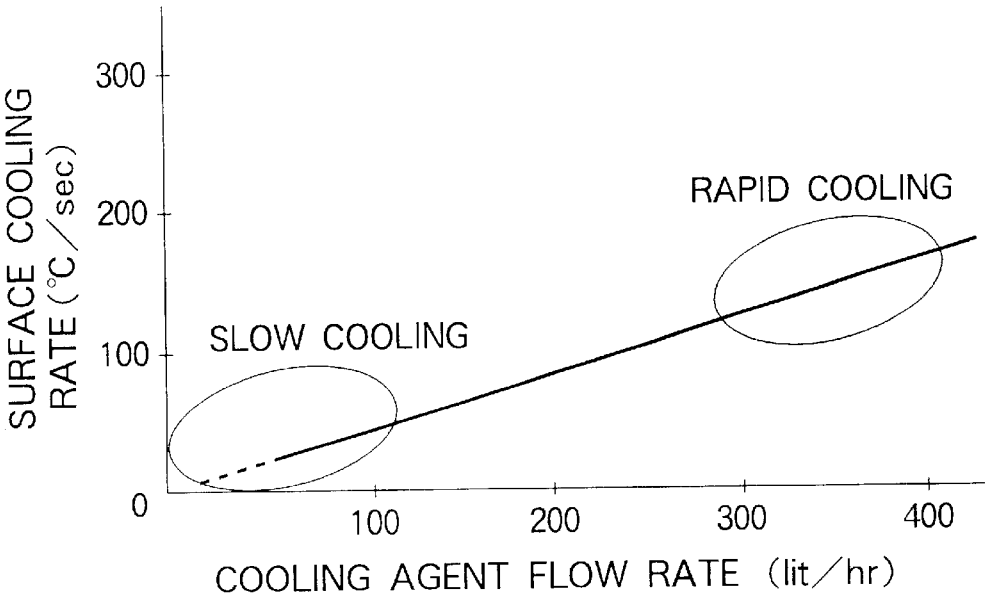
FIG. 23 is a graph showing a rate of cooling of a surface of an object to be cooled in the heat treatment process shown in FIG. 20.

In FIG. 23, a graph is shown illustrating a cooling rate obtained in relation to the above-described separate embodiment. The horizontal axis shows a cooling agent flow rate (litters/hour) while the vertical axis shows a cooling rate (° C./sec). To obtain a uniform distribution pattern, the cooling agent used herein is a flow of water mixed with air at a given flow ratio. As the flow rate of the cooling agent increases, the cooling rate also increases. Conversely, as the flow rate of the cooling agent decreases, the cooling rate also decreases. Thus, the cooling agent flow rate is set to be 300 to 400 lit/hr for rapid cooling while it is set to be in a range of 0 to 100 lit/hr for slow cooling. The term "slow cooling" used herein means to cool the cam portion to such an extent that its temperature, dropped to below point Ms, no longer rises by transfer of the residual heat, as well as to cool the cam portion to such an extent that it does not adversely affect the journal portions thermally.

When the cooling agent flow rate is set to be zero (lit/hr), the cooling is done only by air. This air cooling can also achieve the desired slow cooling. By thus setting the flow rate to be zero upon slow cooling, it becomes possible to omit a control operation required for the slow cooling and associated valves, thereby compacting the general arrangement of the relevant installations. In short, the inventive method is featured in intermittently spraying a cooling agent onto a cooling target in the hardening process.

In the embodiment illustrated in FIG. 21, the cooling rate is changed or switched over only one time. Alternatively, the cooling rate may be switched over twice or more between points A1 and Ms. Where the rate change is only one time, cooling control should be done with great care, because it is likely that both the cam portion and the journal portions are hardened or the cam portion is left unhardened along with the journal portions. Accordingly, the number of switch-overs should desirably be increased so that there will be more control factors which enable the cam portion hardening and journal portion non-hardening.

As thus far explained, in the described embodiment, it is possible to easily provide a non-hardened portion by masking a portion desired not to be hardened. However, there is a fear that since cooling by spraying a cooling agent will cause a hardened portion to have a low temperature, the masked portion desired not to be hardened may also be hardened. Thus, in the embodiment, hardening of the masked portion is prevented by changing the cooling rate during the course of cooling.

Obviously, various minor changes and modifications of the present invention are possible in the light of the above teaching. It is therefore to be understood that within the scope of the appended claims, the present invention may be practiced otherwise than as specifically described.

What is claimed is:

1. A method for heat treating a mold cast product, comprising the steps of:

pouring molten metal for iron-based parts into a mold to produce the cast product having a surface layer;

releasing the cast product from said mold when said cast product surface layer held in contact with said mold is in a temperature range allowing hardening and allowing a shell-like solidified layer to develop; and hardening said cast product released from said mold and having a hardening allowing temperature, by cooling said cast product directly with a cooling agent, said hardening including pre-cooling part of the mold-released cast product where hardness is not required, said hardening further including spraying the cooling agent locally onto another part of said mold-released cast product where hardness is required.

2. A method for heat treating a mold cast product, according to claim 1, wherein said pre-cooling step comprises maintaining said hardness required part of said mold cast product at a temperature higher than an A1 transformation point and cooling said hardness non-required part of said mold cast product to a temperature lower than the A1 transformation point.

3. A method for heat treating a mold cast product, comprising the steps of:

pouring molten metal for iron-based parts into a mold to produce the cast product having a surface layer;

releasing the cast product from said mold when said cast product surface layer held in contact with said mold is in a temperature range allowing hardening and allowing a shell-like solidified layer to develop;

following said cast product releasing step, constraining said product to restrike said cast product so as to correct a shape thereof and continuously subjecting said cast product to forced rapid cooling performed by spraying the cooling agent onto said cast product or by soaking said cast product in the cooling agent while repeating alternate constraining and non-constraining of said cast product; and hardening said cast product released from said mold and having a hardening allowing temperature, by cooling said cast product directly with a cooling agent.

4. A method for heat treating a mold cast product, according to claim 3, wherein said alternate constraining and non-constraining of said cast product is repeated until the temperature of said cast product reaches a martensitic transformation starting temperature (Ms point) and thereafter said cast product is kept in a non-constrained state.

5. A method for heat treating a mold cast product, comprising the steps of:

pouring molten metal for iron-based parts into a mold to produce the cast product having a surface layer;

releasing the cast product from said mold when said cast product surface layer held in contact with said mold is in a temperature range allowing hardening and allowing a shell-like solidified layer to develop;

hardening said cast product released from said mold and having a hardening allowing temperature, by cooling said cast product directly with a cooling agent; and interrupting said cooling when the temperature of said cast product surface layer drops to below a martensitic transformation starting temperature (Ms point) while the temperature of the inside of said cast product remains higher than the temperature of said cast product surface layer, so that self tempering of said cast product surface layer is effected by an internal residual heat of said cast product.

6. A method for heat treating a mold cast product, comprising the steps of:

pouring molten metal for iron-based pans into a mold to produce the cast product having a surface layer;

releasing the cast product from said mold when said cast product surface layer held in contact with said mold is in a temperature range allowing hardening and allowing a shell-like solidified layer to develop;

hardening said cast product released form said mold and having a hardening allowing temperature, by cooling said cast product directly with a cooling agent; said hardening step including locally hardening hardness required part of said mold-released cast product by spraying the cooling agent onto said hardness required cast product part; and interrupting said cooling when the temperature of said cast product surface layer drops to below a martensitic transformation starting temperature (Ms point) and while the temperature of a cooling agent unsprayed part and the inside of a cooling agent sprayed part of said cast product remains higher than the temperature of said cast product surface layer, so tat said hardened part is self tempered by a residual heat of said cooling agent unsprayed part and an internal residual heat of said cooling agent sprayed part.

7. A method for heat treating a mold cast product, comprising the steps of:

pouring molten metal for iron-based parts into a mold to produce the cast product having a surface layer;

releasing the cast product from said mold when said cast product surface layer hold in contact with said mold is in a temperature range allowing hardening and allowing a shell-like solidified layer to develop;

masking a hardness non-required part of said mold-released cast product; and hardening said cast product released from said mold and having a hardening allowing temperature, by cooling said cast product directly with a cooling agent, said hardening including spraying the cooling agent onto a hardness required part of said cast product and causing a cooling rate to fall at least once during a drop in temperature of the target of cooling from an A1 transformation point to a martensitic transformation starting temperature (Ms point).

8. A method for heat treating a mold cast product, according to claim 7, wherein said hardening step comprises intermittently spraying the cooling agent onto the hardness required part and causing a cooling rate to fall at least once during a drop in temperature of the target of cooling from the A1 transformation point to the martensitic transformation starting temperature (Ms) by interrupting the cooling agent spraying.

* * * * *